US008354800B2

(12) United States Patent
Stack

(10) Patent No.: US 8,354,800 B2
(45) Date of Patent: Jan. 15, 2013

(54) LIGHTING SOURCE WITH LOW TOTAL HARMONIC DISTORTION

(75) Inventor: Thomas E Stack, Oxford, MI (US)

(73) Assignee: Q Technology, Inc., Livermore, CA (US)

( * ) Notice: Subject to any disclaimer, the term of this patent is extended or adjusted under 35 U.S.C. 154(b) by 247 days.

(21) Appl. No.: 12/455,127

(22) Filed: May 28, 2009

(65) Prior Publication Data

US 2010/0060182 A1 Mar. 11, 2010

Related U.S. Application Data

(60) Provisional application No. 61/191,307, filed on Sep. 7, 2008, provisional application No. 61/199,493, filed on Nov. 16, 2008.

(51) Int. Cl.
*H05B 37/00* (2006.01)

(52) U.S. Cl. ..... 315/250; 315/201; 315/228

(58) Field of Classification Search ..... 315/200 R, 315/201, 246, 250
See application file for complete search history.

(56) References Cited

U.S. PATENT DOCUMENTS

| | | | | | |
|---|---|---|---|---|---|
| 4,887,074 | A | | 12/1989 | Simon | |
| 5,378,964 | A | * | 1/1995 | Kang | 315/247 |
| 5,519,289 | A | * | 5/1996 | Katyl et al. | 315/224 |
| 5,559,405 | A | * | 9/1996 | Notohamiprodjo | 315/209 R |
| 5,703,438 | A | * | 12/1997 | Nguyen | 315/291 |
| 5,786,670 | A | * | 7/1998 | Nguyen | 315/200 R |
| 5,874,809 | A | * | 2/1999 | Hagen | 315/224 |
| 5,936,599 | A | | 8/1999 | Reymon | |
| 6,049,177 | A | * | 4/2000 | Felper | 315/219 |
| 6,091,206 | A | * | 7/2000 | Siao | 315/219 |
| 6,100,648 | A | * | 8/2000 | Moisin | 315/224 |
| 6,181,079 | B1 | * | 1/2001 | Chang et al. | 315/247 |
| 6,326,740 | B1 | * | 12/2001 | Chang et al. | 315/291 |
| 6,362,575 | B1 | * | 3/2002 | Chang et al. | 315/224 |
| 6,853,150 | B2 | | 2/2005 | Clauberg | |
| 6,879,114 | B2 | * | 4/2005 | Jales et al. | 315/209 R |
| 7,061,188 | B1 | * | 6/2006 | Katyl et al. | 315/291 |
| 7,352,139 | B2 | * | 4/2008 | Ribarich et al. | 315/312 |
| 7,420,335 | B2 | * | 9/2008 | Robinson et al. | 315/224 |
| 7,429,833 | B2 | * | 9/2008 | Peng et al. | 315/307 |
| 7,816,872 | B2 | * | 10/2010 | Nerone et al. | 315/224 |
| 7,876,060 | B2 | * | 1/2011 | Alexandrov | 315/307 |
| 2003/0122502 | A1 | * | 7/2003 | Clauberg et al. | 315/291 |
| 2007/0273299 | A1 | * | 11/2007 | Miskin et al. | 315/250 |
| 2008/0203936 | A1 | * | 8/2008 | Mariyama et al. | 315/246 |
| 2008/0211421 | A1 | * | 9/2008 | Lee et al. | 315/250 |
| 2009/0009100 | A1 | * | 1/2009 | Rooymans | 315/246 |
| 2009/0167202 | A1 | | 7/2009 | Miskin | |
| 2009/0244891 | A1 | | 10/2009 | Miskin | |

* cited by examiner

*Primary Examiner* — Jason M Crawford
(74) *Attorney, Agent, or Firm* — Theodore C. Huff

(57) ABSTRACT

A low THD lighting system is disclosed. The lighting system includes a first lighting module and a second lighting module connected parallel to the first lighting module. During each AC cycle the first lighting module conducts current for a first portion of the cycle and the second lighting module conducts current for a second portion of the cycle. When combined, the total current drawn from the power source substantially tracks the shape of the applied AC voltage. Accordingly, there is minimal distortion, and low total harmonic distortion level is achieved.

32 Claims, 15 Drawing Sheets

LIGHTING SOURCE WITH LOW TOTAL HARMONIC DISTORTION

CROSS-REFERENCE TO RELATED APPLICATIONS

This patent application claims the benefit of priority under 35 USC sections 119 and 120 of a provisional patent application filed Sep. 7, 2008 having Application Ser. No. 61/191,307 and a provisional patent application filed Nov. 16, 2008 having Application Ser. No. 61/199,493. The entirety of both the 61/191,307 application and the 61/199,493 application are incorporated herein by reference. The applicant claims benefit to Sep. 7, 2008 as the earliest priority date.

BACKGROUND

The present invention relates generally to lighting systems having low total harmonic distortion characteristics, and more particularly to a lighting system including an inventive configuration of light emitting devices such as, for example, LEDs, to achieve low total harmonic distortion characteristics.

In lighting systems and technology, there has been and continues to be an ever increasing desire to achieve a number of competing and often conflicting goals. For example, these goals include, inter alia, reliability, minimal cost, and minimization of electrical interferences. This is not a complete list. In particular, the goal of minimizing electrical interferences has proven difficult to achieve without increasing costs and decreasing reliability.

Lighting systems typically connect to alternating current (AC) electrical power source and generate light by drawing current from the AC power source. In the U.S., the AC power provides a cyclical voltage of approximately 120 volts RMS (root mean square) with a peak voltage value ranging from approximately positive 170 volts (V) to approximately negative 170 volts. In Europe and other countries, the available AC power is approximately 240 volts RMS. Other countries may use a different frequency, for example, 50 Hz. Other platforms (for example, aircraft avionics) may use another frequency such as 400 Hz. The same principles apply to the following discussion regardless of applied oscillatory voltage or frequency.

The AC power is cyclical with an oscillation frequency of approximately 60 Hertz (Hz) for the example application. Each complete voltage oscillation is considered a complete power cycle and includes 360 degrees. A sample AC power cycle is often illustrated as a sinusoidal graph as illustrated in FIG. 1, which illustrates a number of oscillations of the AC power voltage as represented by a solid line graph 120*v*. In FIG. 1, the horizontal axis represents time flowing from left to right, and the vertical axis for solid graph 120*v* represents voltage amplitude in volts. As illustrated, a single power cycle, in this example, lasts approximately 16.7 milliseconds (ms) which is one second divided by 60 cycles.

Electrical interferences are often measured in total harmonic distortion (THD) compared to the input AC power. In the present context, THD is a measure of extent or magnitude to which the wave shape of the electrical current drawn from the AC power is distorted compared to the sinusoidal shape of the AC voltage 120*v*. In numerical terms, THD is expressed as a percentage calculated as the ratio of the sum of the powers of all harmonic frequencies above the fundamental frequency to the power of the fundamental frequency. In the present example, the fundamental frequency of the AC power is 60 Hz. It is desirable to minimize electrical interferences generated by a lighting system by minimizing lighting system THD.

Many current lighting systems use fluorescent bulbs, especially for industrial and commercial applications. Fluorescent bulbs are more efficient compared to incandescent bulbs. However, fluorescent bulbs are notoriously noisy. That is, fluorescent bulbs draw current from the AC power source such that undesirably high levels of total harmonic distortions (THD) are generated. This is illustrated using FIGS. 1A and 2A.

FIG. 2A illustrates a lighting system including a fluorescent bulb 10 connected to an electrical plug 12. The plug 12 is adapted to engage in a socket that provides the electrical power 120, the alternating current (AC) described above. In FIG. 2A, the load on the provided AC power 120 is the fluorescent bulb 20. Often, an inductor 15 is serially connected with the bulb 10 to limit the current flowing through the bulb 10. A representative dashed graph 10*i* is an approximation of the shape of the current through the bulb 10. The actual conduction duration, the maximum and minimum currents $+I_{MAX}$ and $-I_{MIN}$, and the exact shape of the representative dashed graph 10*i* depend on a number of factors. The factors may include, for example only, wattage rating of the bulb 10, ambient temperature, exact waveshape and characteristics of the power voltage 120*v*, characteristics of the inductor 15, many others not listed here, or a combination of any one or more of these factors. For the purpose of discussing the background, the exact numerical value and the exact shape of these curves are not important; however, the maximum positive and negative currents, $+I_{MAX}$ and $-I_{MAX}$ typically range between plus and minus 670 mA (peak of the AC waveform). The shape of the illustrated curve 10*i* is one possible sample shape only and may not indicate the exact shape of the current flow graph which may vary widely as already noted above.

FIG. 1A is a graph illustrating electrical characteristics of the lighting system of FIG. 2A. Referring to FIGS. 1A and 2A, the AC power voltage 120*v* is a sinusoidal shaped graph 120*v* having 60 Hz oscillation. Current through the fluorescent bulb 10 is represented by representative dashed graph 10*i*. The applied AC power 120 drives current flow (as illustrated by the representative dashed graph 10*i*) through the fluorescent bulb 10. As illustrated in FIG. 1A, the shape of the current 10*i* through the fluorescent bulb 10 is highly dissimilar to the sinusoidal shape of the AC voltage 120*v*. In fact, the shape of the current 10*i* is exceedingly distorted compared to the shape of the AC voltage 120*v*. This is because the fluorescent bulb 20 presents a highly non-linear load to the applied AC voltage 120*v*. This is caused by a number of factors including, for example only, the operating characteristics of fluorescent bulbs. The high degree of distortion of the current 10*i* means that the total harmonic distortion is correspondingly high.

In some implementations, the THD value of fluorescent bulbs exceeds 100 percent. That is, more current is drawn at non-fundamental frequencies compared to the current drawn at the fundamental frequency. Such high THD value leads to a number of undesired affects such as, for example, stresses to wires, circuits, and all other systems connected to the same AC source 120. Further, the high THD value results in undesired levels of electrical noise to all surrounding and commonly connected circuits and electrical systems. In some jurisdictions, there are efforts to limit and regulate the THD values of various circuits allowed to be operated within the jurisdiction.

In most fluorescent bulb based lighting systems, the fluorescent bulb is isolated from the AC power 120 by a ballast circuit that operates to reduce the THD. FIG. 2B illustrates the lighting system of 2A with a ballast 17 connected to the fluorescent bulb 10 on one side and the electrical plug 12 on the other side. The ballast 17 regulates the current flowing through the fluorescent bulb 10 to decrease distortion of the shape of the current, thereby reducing the THD. However, the ballast 17 introduces additional electrical components. These additional electrical components increase the costs and reduce the reliability of the fluorescent bulb based lighting system.

New and increasing popular lighting technology involves the use of light emitting diodes (LEDs). LEDs are cost effective and have higher luminous efficacy compared to incandescent bulbs and fluorescent bulbs. FIG. 3 illustrates a lighting system including a first light emitting diode (LED) 21 connected to the plug 12 in a first direction and a second light emitting diode (LED) 22 connected to the plug 12 in the opposite direction and also connected to the LED 21 in parallel. Collectively, the LEDs 21 and 22 are referred to herein as the LED pair 20. As with the lighting system FIG. 2A, the plug 12 is adapted to engage in a socket that provides the electrical power 120 as described above. In FIG. 3, the load to the electrical power 120 is the LED pair 20. LEDs are diodes that conduct electricity in one direction. To take advantage of the alternating current power source 120, two LEDs are configured as shown to produce light. Often, a resistor 25 is serially connected with the LED pair 20 to limit the current flowing through the LED pair 20.

FIG. 1B is a graph illustrating electrical characteristics of the lighting system of FIG. 3. Referring to FIGS. 1B and 3, during the positive portion 121 (also, the "positive swing") of each power cycle, node 122 is at positive voltage compared to node 124. During the positive swing 121, the first LED 31 is forward biased and the second LED 32 is reverse biased, thus, no current flows through the second LED 32. However, after a threshold voltage ($+V_{TH}$) is reached, current flows through the first LED 31, generating light.

During the negative portion 123 (also, the "negative swing") of each of the power cycles, tab point 124 is at positive voltage compared to tab point 122. During the negative swing 123, the first LED 31 is reverse-biased and the second LED 32 is forward biased, thus, no current flows through the first LED 31. However, after a threshold voltage ($-V_{TH}$) is reached, current flows through the second LED 33, generating light.

The lighting system of FIG. 3 has electrical characteristics similar to that of the lighting system of FIG. 2A, though possibly with a different current waveform. The representative dashed graph 16*i* of FIG. 1B approximates the shape of the current through the LED pair 20. The actual conduction duration, the maximum and minimum currents $+I_{MAX}$ and $-I_{MIN}$, and the exact shape of the representative dashed graph 16*i* depend on a number of factors. The factors may include, for example only, wattage rating of the LED pair 20, ambient temperature, exact shape and characteristics of the power voltage 120*v*, characteristics of the resistor 25, many others not listed here, or a combination of any one or more of these factors. For the purpose of discussing the background, the exact numerical value and the exact shape of these curves are not important. In one example, the maximum positive and negative currents, $+I_{MAX}$ and $-I_{MAX}$ typically range between plus and minus 80 mA in either direction.

The value of the threshold voltage (positive and negative) depends on the value of the resistor 25 and characteristics of the LED pair 20. The amount of current depends on a number of factors including the wattage rating of the LEDs 20 and the value of the resistor 25. Again, for our purposes here, the exact numerical values of these are not important.

As illustrated in FIG. 1B, the shape of the current (represented by dashed line graph 16*i*) through the LED pair 20 is not similar to the sinusoidal shape of the AC voltage 120*v* and is, in fact, very distorted compared to the shape of the AC voltage 120*v*. This is because the LED pair 20 presents a highly non-linear load to the applied AC voltage 120*v*. This is caused by a number of factors including, for example only, the way LEDs operate to generate light. The high degree of distortion of the current 16*i* means that the total harmonic distortion is correspondingly high. In fact the THD for the LED pair is often over 100 percent.

To realize even lower THD values for LED based lighting systems, some suggested use of complex LED driver circuits between the LEDs and the power source. For example, U.S. Pat. No. 6,304,464 to Jacobs teaches the use of a complex "flyback converter" for, inter alia, THD reduction. In another example, U.S. patent application Ser. No. 11/086,955 having a filing date of Mar. 22, 2005 and publication date of Sep. 28, 2006 teaches the use of a complex "digital power converter for driving LEDS." The use of these LED driver circuits introduces additional electrical components. These additional electrical components increase the complexity and the costs, and reduce the reliability of these LED systems.

Accordingly, the need remains for LED based lighting systems having even lower levels of THD values while eliminating or minimizing the need for additional circuits and components.

SUMMARY OF THE INVENTION

The need is met by the present invention. In a first embodiment of the present invention, a lighting system includes a first lighting module, a second lighting module, a first capacitor, and a second capacitor. The first lighting module includes at least one light emitting element. The second lighting module includes at least one light emitting element. The second lighting module is connected in parallel to the first lighting module. The first capacitor is connected in series with the first lighting module. The first capacitor is connected in parallel to the second lighting module. The second capacitor is connected in series with both the first lighting module and the second lighting module. When electrical power is applied to the lighting system, the first lighting module conducts electrical current during a first conduction period within each power cycle and the second lighting module conducts electrical current during a second conduction period within each power cycle.

In the lighting system, a portion of the first conduction period overlaps a portion of the second conduction period. The first lighting module, when connected to the electrical power source, also conducts during a third conduction period within each power cycle, and the second lighting module, when connected to the electrical power source, also conducts during a fourth conduction period within each power cycle. A portion of the third conduction period overlaps a portion of the fourth conduction period.

The lighting system's first and second lighting modules may each include a plurality of LED pairs wherein each LED pair includes a first LED connected in forward direction and a second LED connected in reverse direction.

Alternatively, the lighting system's first and second lighting modules may each include two parallel sets of LEDs wherein a first set of plural LEDs is serially connected in forward direction and a second set of plural LEDs is serially connected in reverse direction.

The first lighting module includes a first predetermined number of LEDs and the second lighting module includes a second predetermined number of LEDs wherein the first predetermined number is less than the second predetermined number.

In a second embodiment of the present invention, a lighting system is adapted to connect to an electrical power source providing alternating current (AC) electrical power, the electrical power having power cycles. The lighting system includes a first lighting module, a first rectifier, a second lighting module, and a second rectifier. The first lighting module includes at least one light emitting element. The first rectifier is connected to the first lighting module to provide a first rectified signal to the first lighting module. The second lighting module includes at least one light emitting element. The second rectifier is connected to the second lighting module to provide a second rectified signal to the second lighting module. The first rectifier and the first lighting module are connected in parallel to the second rectifier and the second lighting module. With electrical power applied to the lighting system, the first lighting module conducts electrical current during a first conduction period within each power cycle and the second lighting module conducts electrical current during a second conduction period within each power cycle.

The lighting system may also include a first capacitor connected in series with the first lighting module. The lighting system may also include a second capacitor. The second capacitor is connected in series with both the first lighting module and the second lighting module. The lighting system may also include a third capacitor connected parallel to the first lighting module and a fourth capacitor connected parallel to the second lighting module.

In the lighting system, a portion of the first conduction period overlaps a portion of the second conduction period. In the lighting system the first lighting module, when connected to the electrical power source, conducts during a third conduction period within each power cycle, and the second lighting module, when connected to the electrical power source, conducts during a fourth conduction period within each power cycle. A portion of the third conduction period overlaps a portion of the fourth conduction period. The first lighting module includes a first predetermined number of LEDs and the second lighting module includes a second predetermined number of LEDs wherein the first predetermined number is less than the second predetermined number In a third embodiment of the present invention, a lighting system is adapted to connect to an electrical power source providing alternating current (AC) electrical power, the electrical power having power cycles. The lighting system includes a first current path and a second current path. The first current path includes at least one lighting emitting element. The second current path includes at least one light emitting element and is connected in parallel to the first current path. The first current path is adapted to conduct electrical current during a first conduction period within each power cycle and the second current path is adapted to conduct electrical current during a second conduction period within each power cycle.

In a fourth embodiment of the present invention, a method of generating light from an alternating current (AC) electrical power source having power cycles, the method includes the following steps: First, an alternating current power source is provided, the alternating current having a substantially sinusoidal flow characteristics and including continuous power cycles; light is generated during a first conduction period during each power cycle using a first set of light emitting devices (LEDs) by conducting current during the first conduction period; light is generated during a second conduction period during each power cycle using a second set of light emitting devices (LEDs) by conducting current during the second conduction period; and the current conducted during the first conduction period and the second conduction period aggregate to a total conduction current flow that has substantially sinusoidal flow characteristics.

DETAILED DESCRIPTION OF THE INVENTION

The lighting system of the present invention includes lighting elements such as, but not limited to, light emitting diodes (LED) in a configuration to minimize total harmonic distortion while not requiring separate and complex driver circuitry. Here, the challenge, as discussed above, is to generate light from an alternating current (AC) electrical power (the electrical power having power cycles) while generating lower distortion levels (THD, the total harmonic distortion) than previously possible. In the present invention, this is accomplished by having at least two lighting modules in parallel, each module conducting (drawing current thereby generating light) during different periods of each power period. These currents combine such that the shape of the total current drawn by the lighting system is more similar to the sinusoidal shape of the AC power. That is, the lighting system current graph of the present invention has less distortion compared to the AC power sinusoidal shape, than the current graph distortions of prior art lighting systems.

Figure 1A:
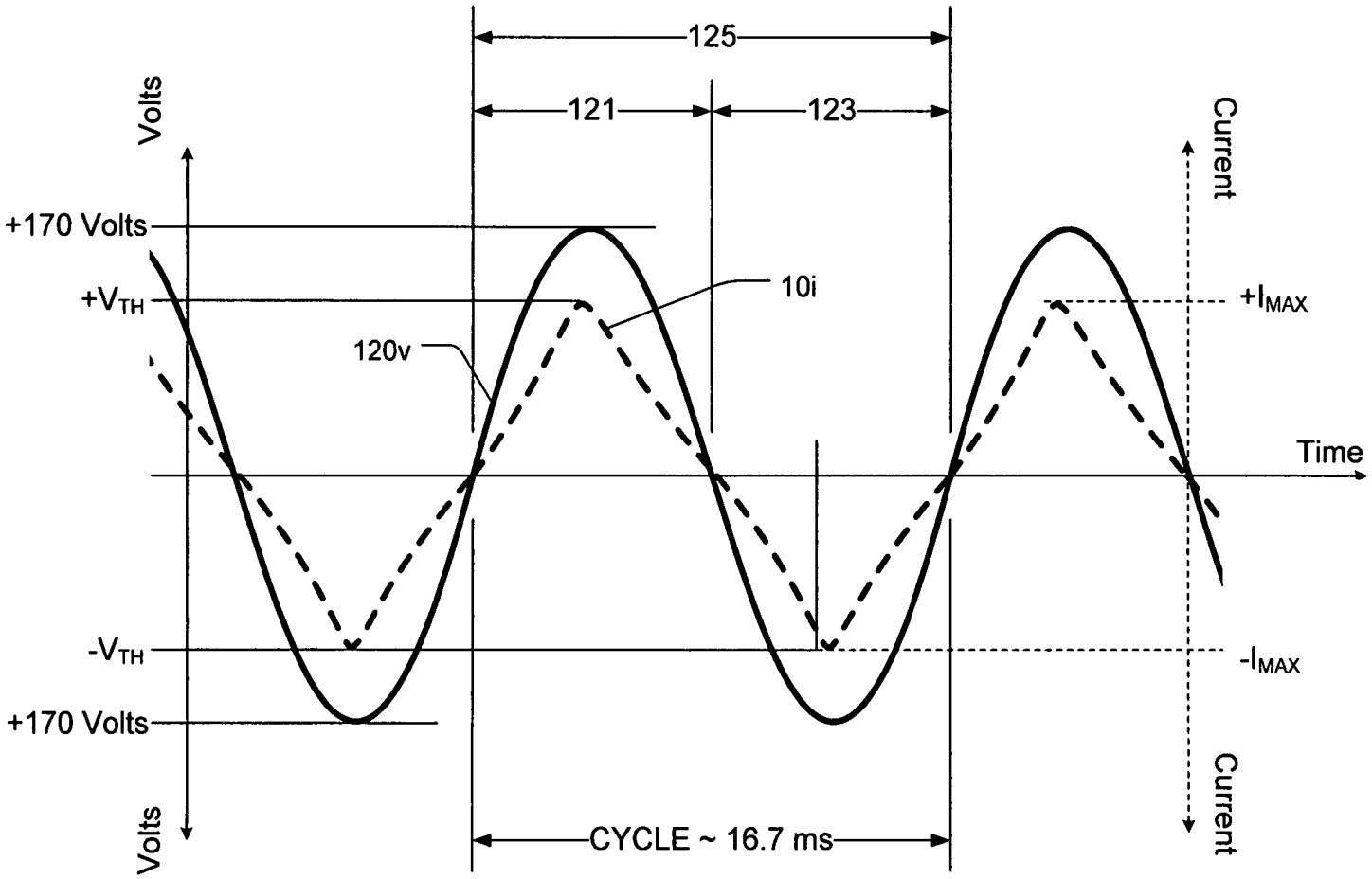
Fig. 1A PRIOR ART
FIG. 1A is a graph illustrating electrical characteristics of the lighting system of FIG. 2A.
Figure 1B:
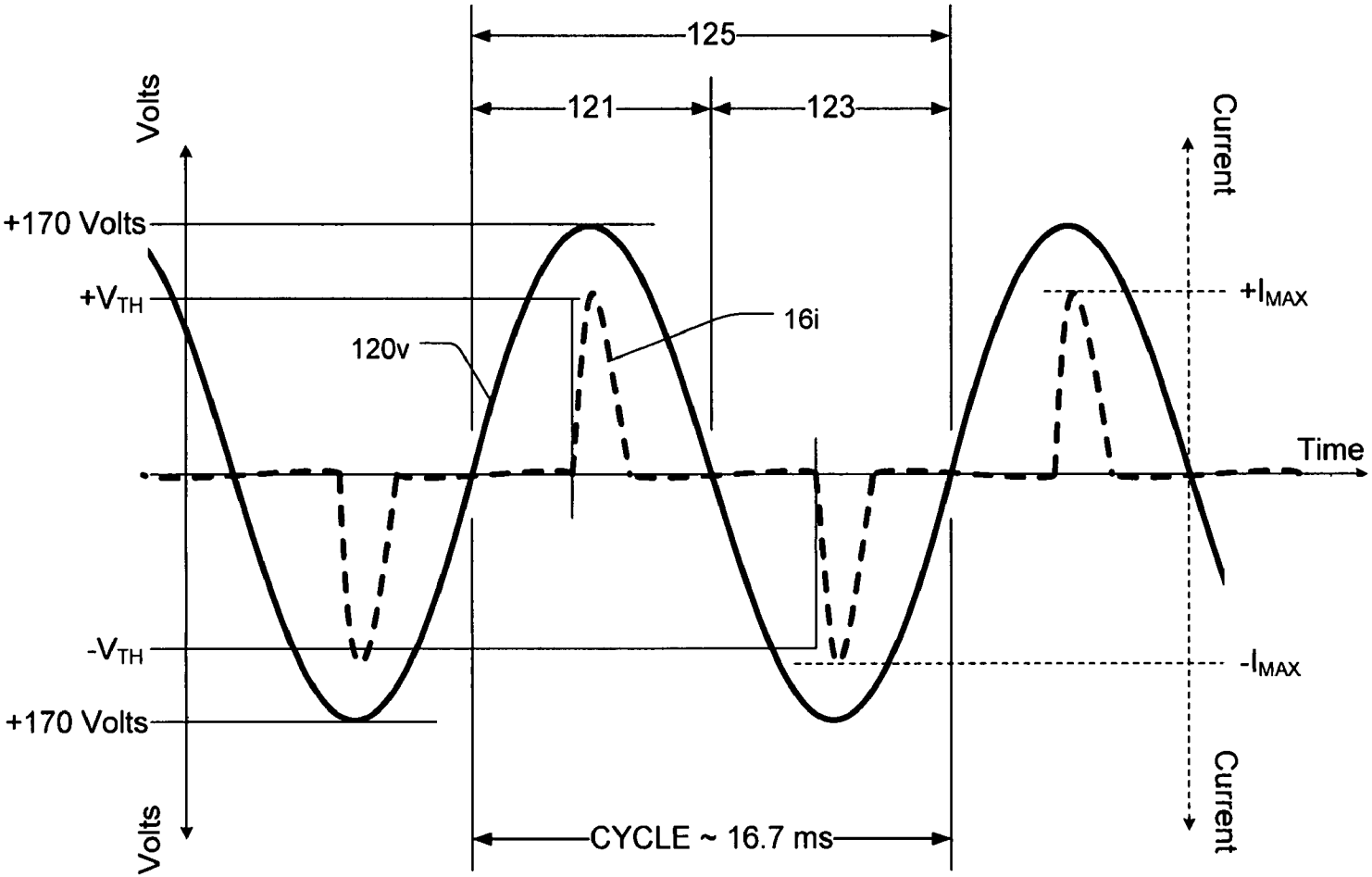
Fig. 1B PRIOR ART
FIG. 1B is a graph illustrating electrical characteristics of the lighting system of FIG. 3.
Figure 2A:
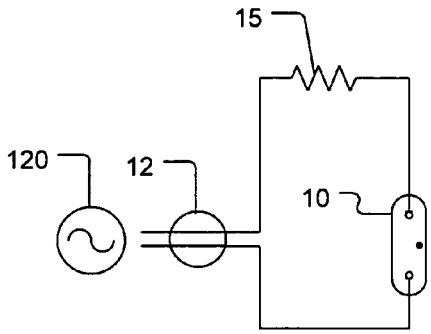
Fig. 2A PRIOR ART
FIG. 2A is a schematic diagram of a prior art lighting system including a fluorescent lamp.
Figure 2B:
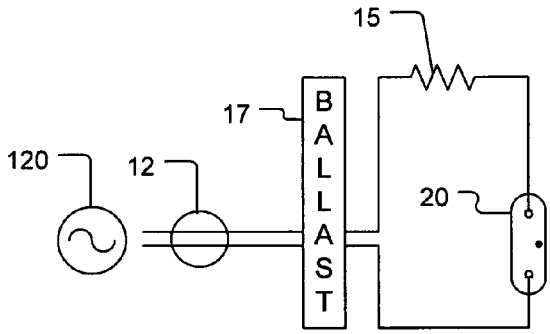
Fig. 2B PRIOR ART
FIG. 2B is schematic diagram of a prior art lighting system illustrated in FIG. 2A with an additional component.
Figure 3:
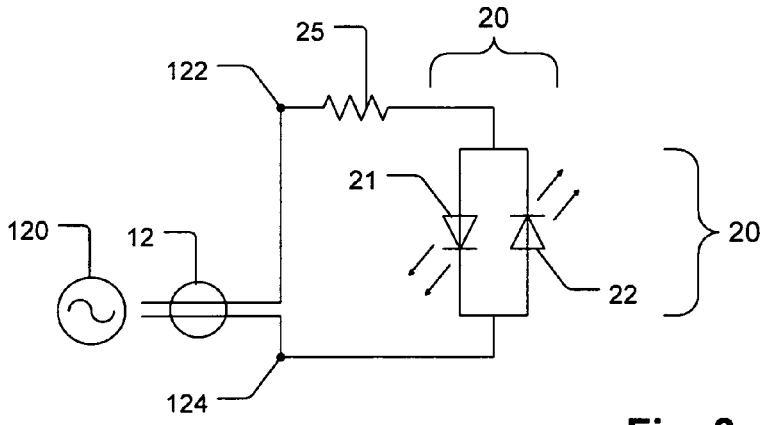
Fig. 3 PRIOR ART
FIG. 3 is a schematic diagram of a prior art lighting system including light emitting diodes.
Figure 4:
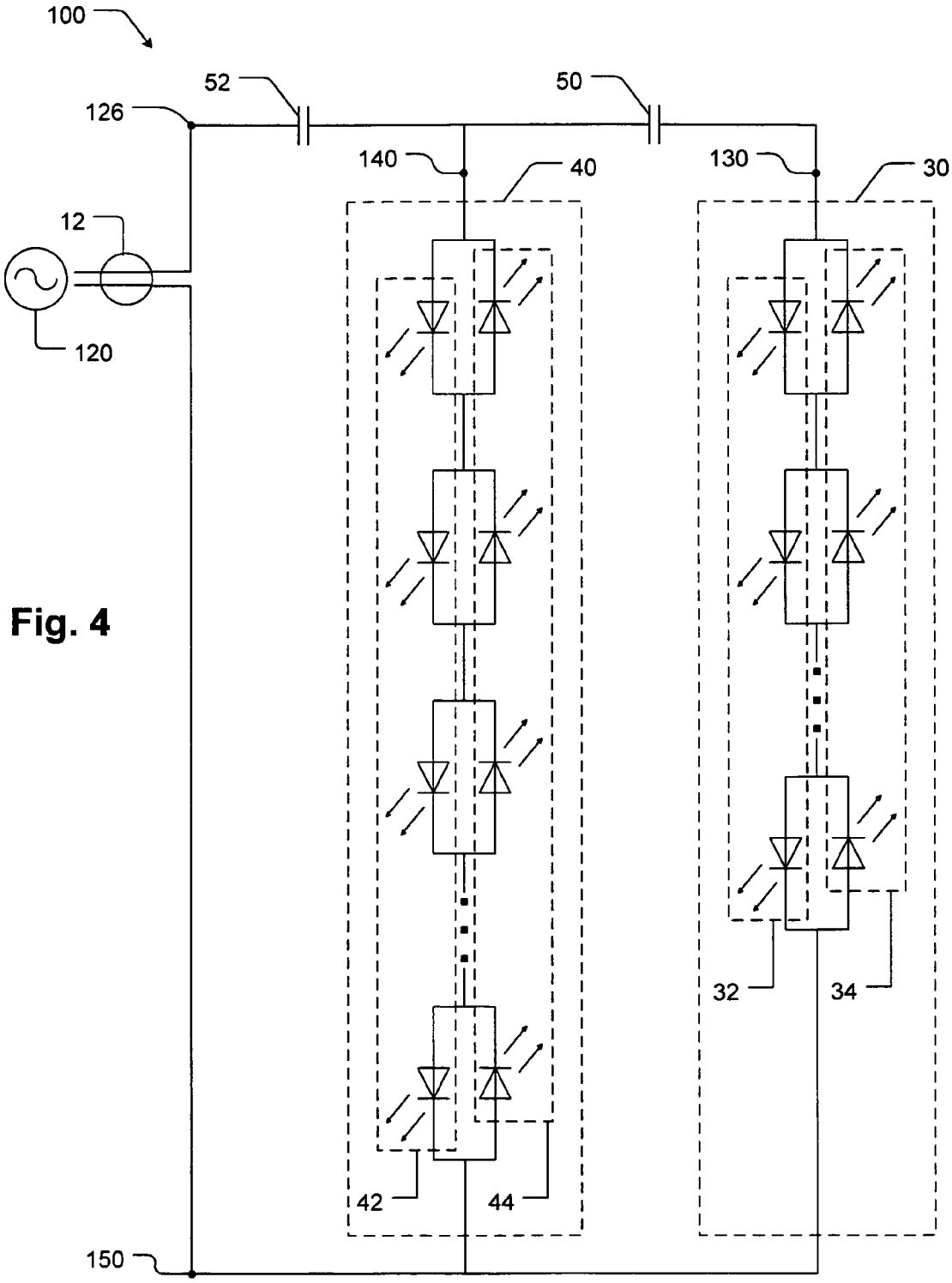
FIG. 4 is a schematic diagram of a lighting system in accordance with one embodiment of the present invention.

FIG. 4 illustrates one embodiment of the lighting system 100 of the present invention. The lighting system 100 of the present invention includes a first lighting module 30 and a second lighting module 40. The first lighting module is adapted to connect to an electrical power source 120 via an electrical plug 12. The electrical power source 120 provides alternating current (AC) electrical power, the electrical power having power cycles. In the U.S., the AC power provides a cyclical voltage of approximately 120 volts RMS (root mean square) with a peak voltage value ranging from approximately positive 170 volts to approximately negative 170 volts. In Europe and other countries, the available AC power is approximately 220 volts RMS. The first lighting module 30 defines a first current path and the second lighting module 40 defines a second current path.

Figure 5:
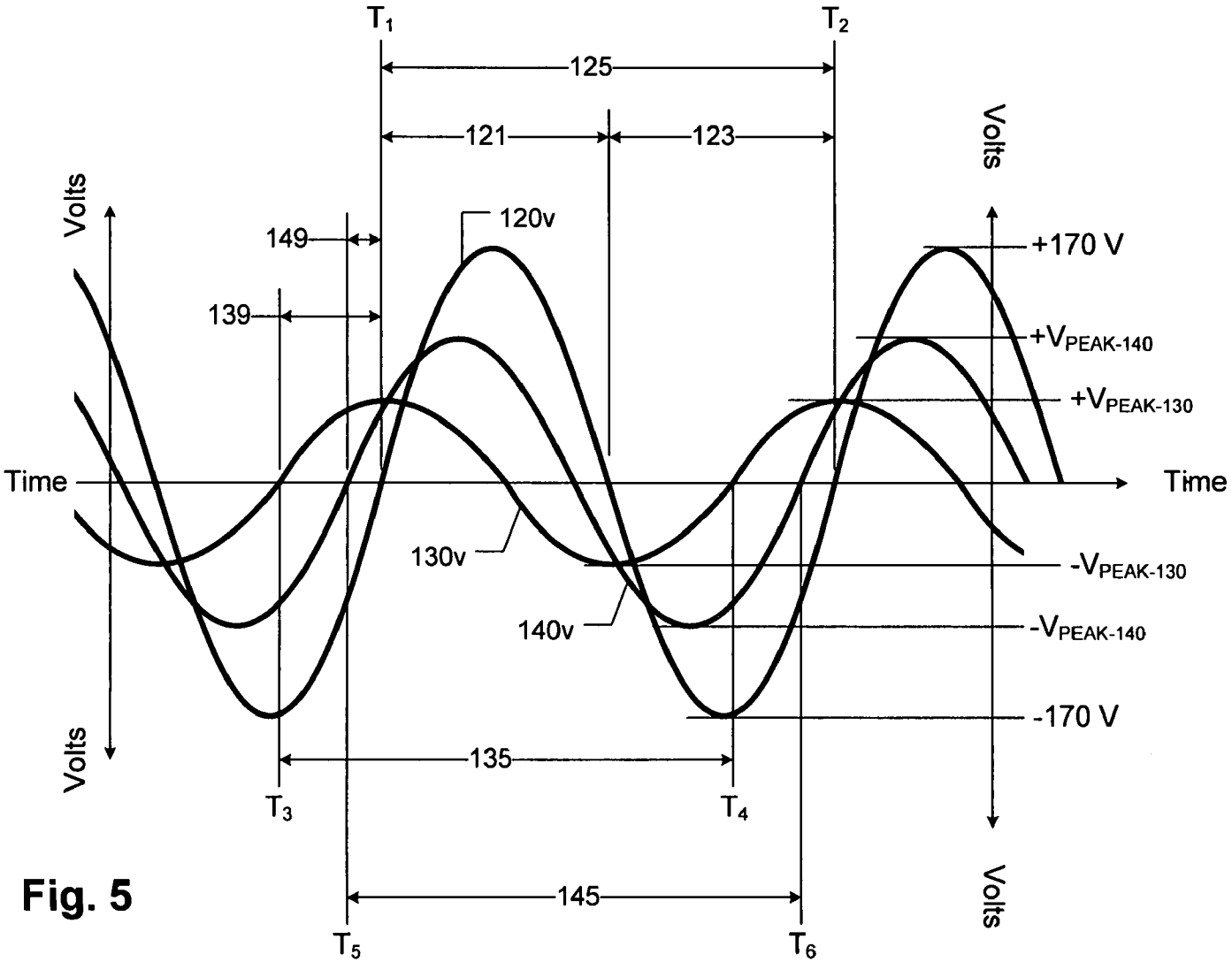
FIGS. 5, 6, 7, 8, and 9 illustrate graphs representing various electrical characteristics of the lighting systems of FIGS. 4, 10 and 11.

The AC power 120 is cyclical in that the AC power has an oscillation frequency of approximately 60 Hertz (Hz). FIG. 5 illustrates a number of oscillations of the AC power voltage as represented by a solid line graph 120*v*. Each complete oscillation of voltages is considered a complete power cycle and includes 360 degrees. In FIG. 5, the horizontal axis represents time flowing from left to right, and the vertical axis for graph 120*v* represents voltage amplitude in volts. As illustrated, a single power cycle, in this example, lasts approximately 16.7 milliseconds (ms) which is one second divided by 60 cycles. For convenience of discussion herein, a single power cycle period 125 is used to discuss the operations of the lighting system 100 of FIG. 4. As for the beginning and the ending of the power cycle period 125, it is arbitrary where the power cycle is deemed to begin and to end as long as the power cycle period 125 includes a complete oscillation, the entire 360 degrees.

Continuing to refer to FIG. 4, the first lighting module 30 includes at least one light emitting element. In the illustrated sample embodiment, the first lighting module 30 includes 12 LED pairs (for a total of 24 individual LEDs), each LED pair having one forward biased LED and one reversed biased LED. In the illustrated sample embodiment, each of the LEDs of the first lighting module 30 has a 2.5 volt turn-on (threshold) voltage with operating voltage of 3.3 volts as observed. Such LEDs are available in the marketplace as, for example, LW540 from Seoul Semiconductor Company, Ltd. Accordingly, for each direction of electrical flow, the first lighting module 30 presents a turn-on threshold voltage of 30.0 volts, $V_{THRESHOLD}$. This number is 2.5 volts multiplied by 12 LEDs in a particular direction. Again, the present invention is not limited in scope to this illustrated embodiment. Selection of direction as "forward" or "reverse" is arbitrary for the purposes of the present invention; however, for the purposes of discussion herein, directions beginning at node 126, through the modules 30 and 40, and ending at node 150 are considered "forward." The number of LEDs may range from one to many depending on the characteristics of the LEDs, the desired current graph, etc.

In the illustrated embodiment, the lighting elements are light emitting diodes (LEDs); however, the present invention is not limited to LEDs as the light emitting element but may include other light emitting devices such as, for example only, Organic Light Emitting Diode (OLED), Light Emitting Polymer (LEP), and Organic Electro Luminescence (OEL), or other lighting means.

The second lighting module 40 is also adapted to connect to the electrical power source 120 via the electrical plug 12. The second lighting module 40 includes at least one light emitting element. In the illustrated sample embodiment, the second lighting module 40 includes 21 LED pairs (for a total of 42 individual LEDs), each LED pair having one forward biased LED and one reverse biased LED. The second lighting module 40 is connected in parallel to the first lighting module 30.

In the illustrated sample embodiment, each of the LEDs of the first lighting module 40 has a 2.5 volt turn-on (threshold) voltage. Accordingly, for each direction of electrical flow, the first lighting module 40 presents a turn-on threshold voltage of 52.5 volts, $V_{THRESHOLD}$. This number is 2.5 volts multiplied by 21 LEDs in a particular direction. The number of LEDs may range from one to many depending on the characteristics of the LEDs, the desired current graph, etc. The second lighting module 40 includes a greater number of lighting elements compared to the number of lighting elements of the first lighting module 30.

A first capacitor 50 is connected in series with the first lighting module 30. The first capacitor is connected in parallel to the second lighting module 40. In the illustrated embodiment, the first capacitor 50 has value of approximately 2.7 microfarad (μF).

A second capacitor 52 is connected in series with both the first lighting module 30 and the second lighting module 40 as illustrated. Further, the second capacitor 52 is connected in series with the first capacitor. In fact, the second capacitor 52 connects to the power source 120 on the one side, and on its other side, the second capacitor 52 connects to the first capacitor 50 and to the second lighting module 40. In the illustrated embodiment, the second capacitor 52 has a value of approximately 3.3 μF.

Operations of the lighting system 100 of FIG. 4 are described below with reference to FIGS. 5 through 9. FIG. 5 is a graph illustrating AC voltages over time of the AC power supply 120 as AC supply voltage 120*v*, AC voltage at node 130 as AC voltage 130*v*, and AC voltage at node 140 as AC voltage 140*v*. Nodes 130 and 140 of FIG. 4 and other "nodes" of the Figures of the present invention merely indicate a location or a point (of the circuit or apparatus) indicated by the reference number and its callout line. Accordingly, the term "node" does not indicate any structure or special protuberance.

Referring to FIGS. 4 and 5, the AC power voltage oscillates between approximately positive 170 V and approximately negative 170 V. Again, this is in the U.S. where the typical AC power outlets supply 120 volts RMS of AC power. In Europe and other countries, the available AC power is approximately 220 volts RMS. A single cycle of the AC power voltage 120*v* is illustrated as power cycle period 125 which begins at time $T_1$ and ends at time $T_2$. As for the beginning and the ending of the power cycle period 125, it is arbitrary where the power cycle is deemed to begin and to end as long as the power cycle period 125 includes a complete oscillation, the entire 360 degrees. In FIG. 5, for convenience of discussion, the power cycle period 125 is illustrated as beginning at $T_1$ when the voltage is at zero, extending through its positive swing period 121 (180 degrees), passing through zero volts, and through its negative swing period 123 (180 degrees) back to the zero voltage at $T_2$, thereby completing its 360 degrees. In the present example, the power cycle period 125 is approximately 16.7 milliseconds (ms). Time references (on the Figures and also used herein) are labeled such as, in general, $T_N$ where the subscripts N used herein indicate various points on the time line and therefore do not indicate that these references occur in the sequence according to the numerical value of N.

The power voltage 120*v* is available from the power supply 120 through connected plug 12, and is operated on by the second capacitor 52. The second capacitor 52 presents capacitance and capacitive reactance to the incoming power voltage such that, at node 140, the power cycle 120*v* is delayed by almost approximately 15.1 ms. The delayed AC voltage 140*v* at node 140 is illustrated in FIG. 5. A single AC voltage cycle 140*v* is illustrated as cycle period 145, which begins at time $T_5$ and ends at time $T_6$. As for the beginning and the ending of the cycle period 145, it is arbitrary where the cycle period is deemed to begin and to end as long as the cycle period 145 includes a complete oscillation, the entire 360 degrees.

In FIG. 5, for convenience of discussion, the cycle period 145 is illustrated as beginning at $T_5$ when the voltage is at zero, extending through its positive swing period, passing through zero volts, and through its negative swing period back to the zero voltage at $T_6$, thereby completing its 360 degrees. In the present example, the cycle period 145 is also approximately 16.7 ms. The cycle period 145 lags the power cycle period 125 by about 15.0 ms which is about 335 degrees in the sinusoidal curve. This conditional is operationally equivalent to the cycle period 145 leading the power cycle period 125 by about 1.6 ms or about 25 degrees (360 less 335 degrees). Such lagging conditions (where the lag is over 180 degrees) are conventionally referred to as the cycle period 145 leading the power cycle period 125. This convention is used in this document. The lead of the voltage 140*v* compared to the power voltage 120*v* is illustrated as gap 149.

The voltage 140*v* at node 140 is operated on by the first capacitor 50. The first capacitor 50 presents capacitance and capacitive reactance to the voltage 140*v* such that, at node 130, the voltage 130*v* leads the voltage 140*v* by about 1.9 ms and leads the power voltage 120*v* by approximately 3.2 ms. The delayed AC voltage 130*v* at node 130 is illustrated in FIG. 5. A single cycle of the AC voltage 130*v* is illustrated as cycle period 135, which begins at time $T_3$ and ends at time $T_4$. As for the beginning and the ending of the cycle period 135, it is arbitrary where the cycle period is deemed to begin and to end as long as the cycle period 135 includes a complete oscillation, the entire 360 degrees. The actual peak (both positive and negative) values of the AC voltage 140*v*, $V_{PEAK\text{-}140}$, may vary depending on implementation and the peaks of the power voltage 120*v*. In the illustrated sample implementation, positive and negative peak voltages $V_{PEAK\text{-}140}$ are approximately plus and minus 92 volts. The lead of the voltage 130*v* compared to the power voltage 120*v* is illustrated as gap 139.

In FIG. 5, for convenience of discussion, the cycle period 135 is illustrated as beginning at $T_3$ when the voltage is at zero, extending through its positive swing period, passing through zero volts, and through its negative swing period back to the zero voltage at $T_4$, thereby completing its 360 degrees. In the present example, the cycle period 135 is also approximately 16.7 ms. The cycle period 135 leads the power cycle period 125 by about 3.1 ms or about 86 degrees. The AC voltage 130*v* is experienced by the first lighting module 30. The actual peak (both positive and negative) values of the AC voltage 130*v*, $V_{PEAK\text{-}130}$, may vary depending on implementation and the peaks of the power voltage 120*v*, $V_{PEAK\text{-}140}$, or both. In the illustrated sample implementation, $V_{PEAK\text{-}130}$ is approximately plus and minus 52 volts.

Figure 6:
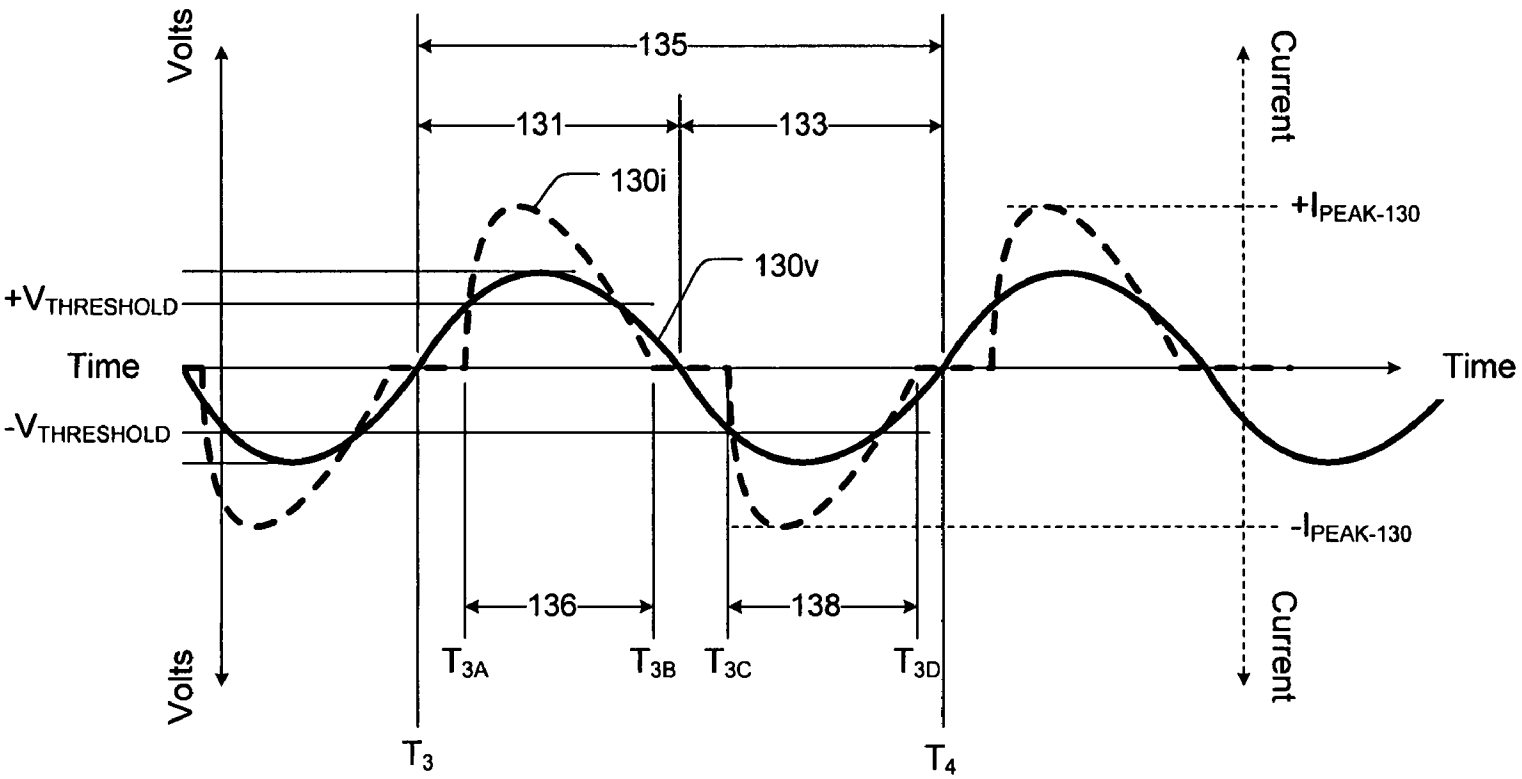

FIG. 6 is a graph illustrating AC voltages at node 130 as AC voltage 130*v* and current conducting through the first lighting module 30 as graph 130*i* having a dash line. The operations of portions of the lighting system 100 are described here with reference to FIGS. 4 and 6 beginning at time $T_3$. During the positive swing 131 of the AC voltage 130*v*, the voltage 130*v* increases from zero to some threshold turn-on voltage (in the forward direction) at time $T_{3A}$. Beginning at $T_{3A}$, forward biased LEDs 32 of the first lighting module 30 begin to conduct electrical current thereby generating light. During the positive swing 131, reverse biased LEDs 34 do not conduct electricity. The forward biased LEDs 32 continue to conduct current until time $T_{3B}$ when the AC voltage 130*v* decreases below the threshold voltage. The temporal period between $T_{3A}$ and $T_{3B}$ is referred to as the first conduction period 136. The actual value of the threshold voltage, $V_{THESHOLD}$, is implementation dependent. In the illustrated embodiment, $+V_{THESHOLD}$ is approximately 34 volts. The actual peak (both positive and negative) values of the current 130*i*, $I_{PEAK\text{-}130}$, may vary depending on implementation. In the illustrated sample implementation, positive and negative peak currents $I_{PEAK\text{-}130}$ are approximately plus and minus 80 mA.

During the negative swing 133 of the AC voltage 130*v*, the voltage 130*v* decreases from zero to some threshold turn-on voltage (in the reverse direction) at time $T_{3C}$. Beginning at $T_{3C}$, the reverse biased LEDs 34 of the first lighting module 30 begin to conduct electrical current thereby generating light. During the negative swing 133, forward biased LEDs 34 do not conduct electricity. The reverse biased LEDs 34 continue to conduct current until time $T_{3D}$ when the AC voltage 130*v* increases above the threshold voltage (in the reverse direction). The temporal period between $T_{3C}$ and $T_{3D}$ is referred to herein as the third conduction period 138.

Figure 7:
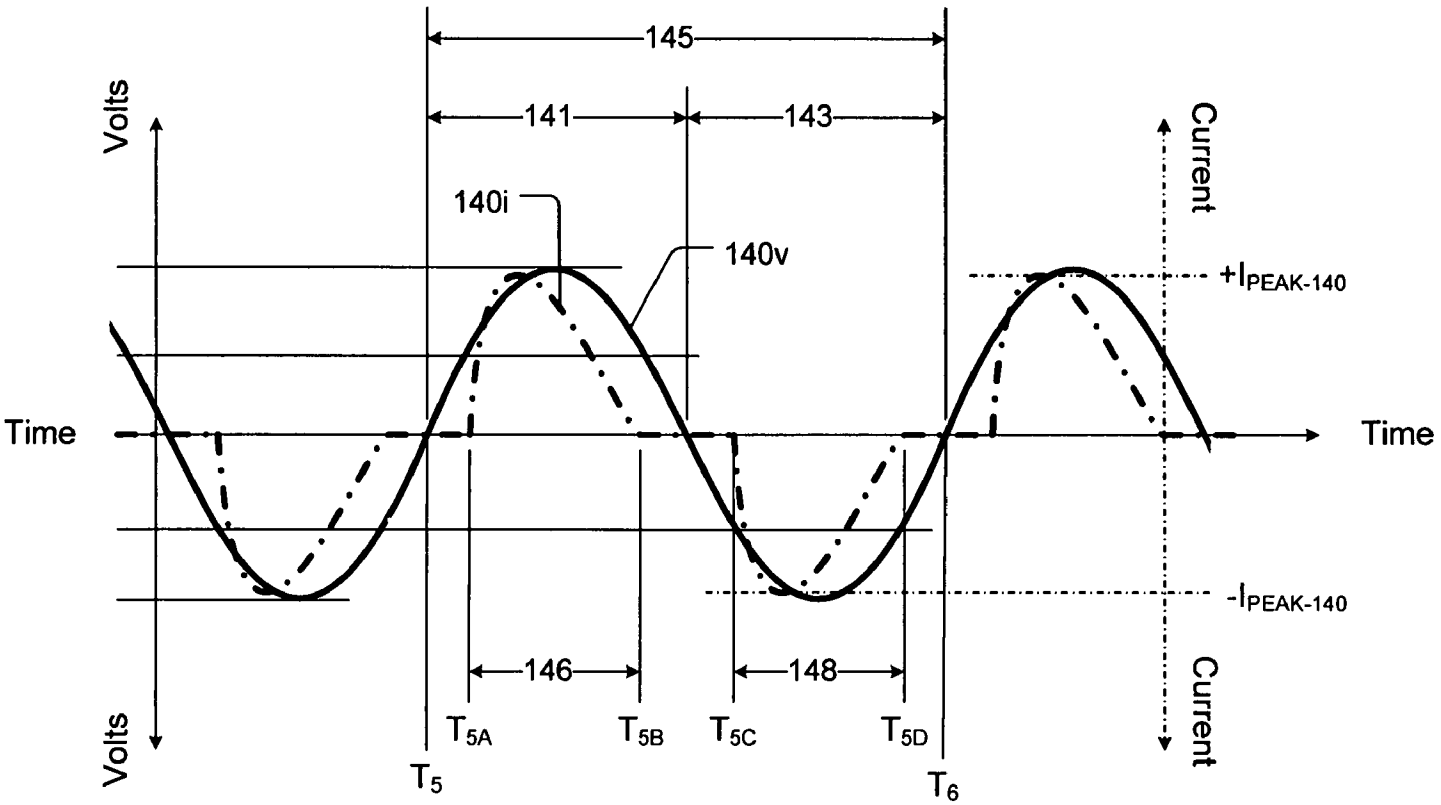

FIG. 7 is a graph illustrating AC voltages at node 140 as AC voltage 140*v* and current conducting through the second lighting module 40 as graph 140*i* having a dash-dot line. The operations of portions of the lighting system 100 are described here with reference to FIGS. 4 and 7 beginning at time $T_5$. During the positive swing 141 of the AC voltage 134*v*, the voltage 140*v* increases from zero to some threshold turn-on voltage (in the forward direction) at time $T_{5A}$. Beginning at $T_{5A}$, forward biased LEDs 42 of the second lighting module 40 begin to conduct electrical current thereby generating light. During the positive swing 141, reverse biased LEDs 44 do not conduct electricity. The forward biased LEDs 42 continue to conduct current until time $T_{5B}$ when the AC voltage 140*v* decreases below the threshold voltage. The temporal period between $T_{5A}$ and $T_{5B}$ is referred to as the second conduction period 146. The actual value of the threshold voltage, $V_{THESHOLD}$, is implementation dependent. In the illustrated embodiment, $+V_{THESHOLD}$ is approximately 55 volts. The actual peak (both positive and negative) values of the current 140*i*, $I_{PEAK\text{-}140}$, may vary depending on implementation. In the illustrated sample implementation, positive and negative peak currents $I_{PEAK\text{-}140}$ are approximately plus and minus 80 mA.

During the negative swing 143 of the AC voltage 140*v*, the voltage 140*v* decreases from zero to some threshold turn-on voltage (in the reverse direction) at time $T_{5C}$. Beginning at $T_{5C}$, the reverse biased LEDs 44 of the second lighting module 40 begin to conduct electrical current thereby generating light. During the negative swing 143, forward biased LEDs 44 do not conduct electricity. The reverse biased LEDs 44 continue to conduct current until time $T_{5D}$ when the AC voltage 140*v* increases above the threshold voltage (in the reverse direction). The temporal period between $T_{5C}$ and $T_{5D}$ is referred to herein as the fourth conduction period 148.

Figure 8:
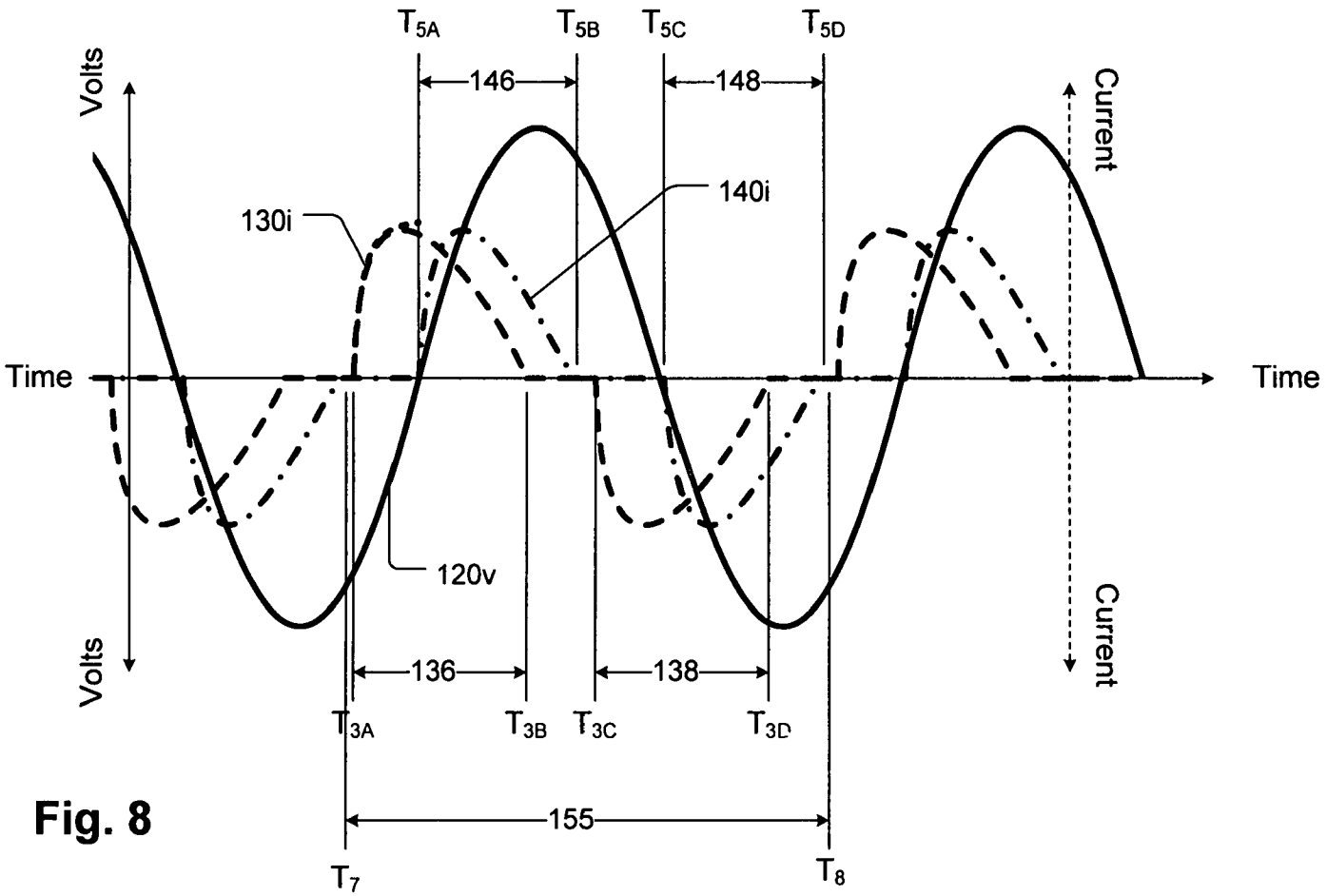

FIG. 8 illustrates a graph including portions of FIGS. 5 through 7. FIG. 8 overlays the AC power voltage as represented by a solid line graph 120*v* with the first module current 130*i* (dash line, same as 130*i* of FIG. 6) and the second module current 140*i* (dash-dot line, same as 140*i* of FIG. 7). Referring to FIG. 8, an AC power cycle 155 is illustrated, the power cycle period 155 spanning a complete oscillation, the entire 360 degrees from time $T_7$ and time $T_8$. The power cycle period 155 is same as the power cycle period 125 of previous Figures but for the fact that it begins at a different time $T_7$ compared to the beginning time of $T_1$ of the power cycle 125. However, this is irrelevant. Again, it is arbitrary where the power cycle is deemed to begin and to end as long as the power cycle period includes a complete oscillation, the entire 360 degrees. In FIG. 8, for convenience of discussion, the power cycle period 155 is illustrated as beginning at $T_7$ which is before the beginning $T_{3A}$ of the first conduction period 136 and is after the end $T_{5D}$ of the fourth conduction period 138.

Referring now to FIGS. 4 and 8, during the application of the power cycle 155 to the lighting system 100, the first lighting module 30 conducts electrical current (in the forward direction) during the first conduction period 136 and during the third conduction period 138. This is illustrated by the first module current 130*i*. Additionally, during the application of the power cycle 155 to the lighting system 100, the second lighting module 40 conducts electrical current (in the reverse direction) during the second conduction period 146 and during the fourth conduction period 148. This is illustrated by the second module current 140*i*. As illustrated, the lighting modules 30 and 40 are connected in parallel to each other. Accordingly, these currents are added to determine the total current for the lighting system 100. The total current drawn by the lighting system 100 is the sum of currents 130*i* (drawn by the first lighting module 30) and 140*i* (drawn by the second lighting module 40) and is referred herein as the light system current.

Figure 9:
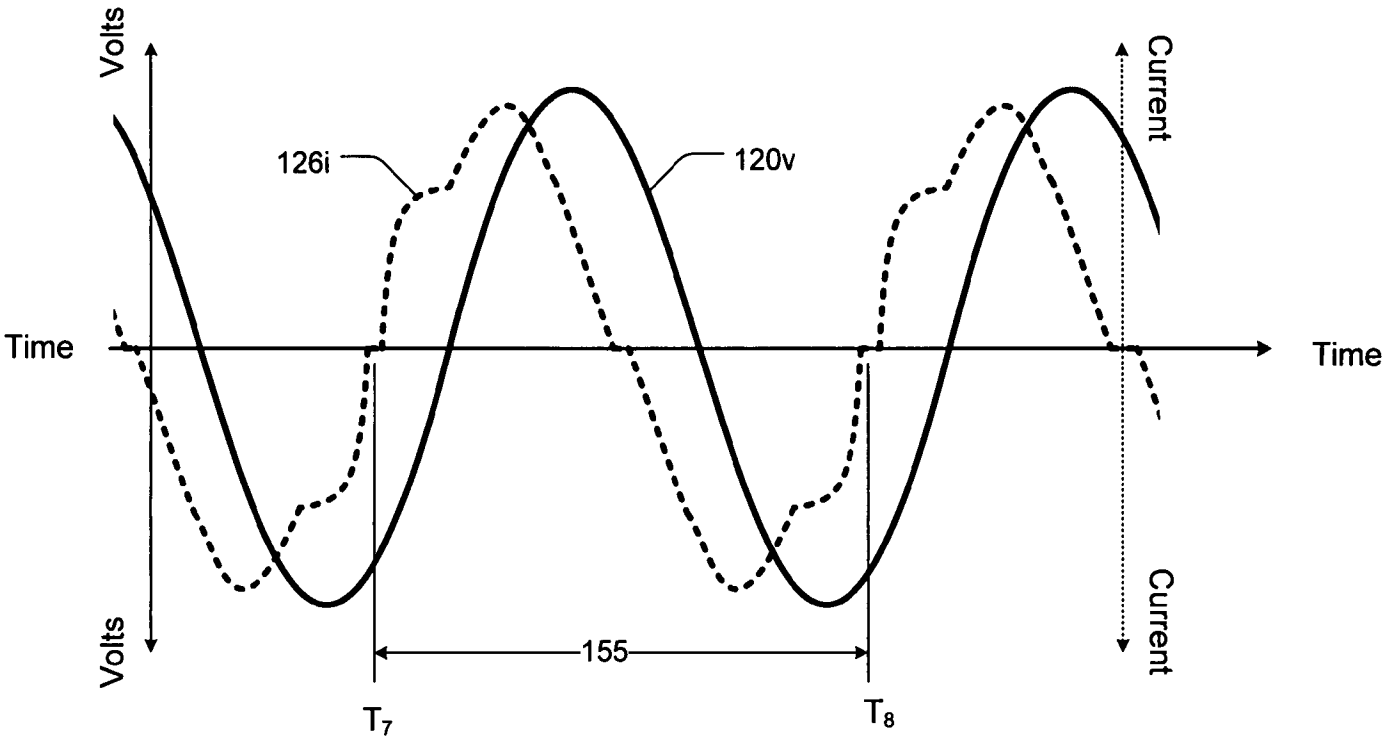

FIG. 9 illustrates the total current (light system current) as dash line graph 126*i* as measured at the node 126 and the power cycle 155 from $T_7$ to $T_8$. As is apparent from FIG. 9, the shape of the light system current 126*i* is similar to the shape of the power supply voltage 120*v*. That is, the shape of the light system current 126*i* is only slightly distorted compared to the shape of the power supply voltage 120*v*. Accordingly, the total harmonic distortion (THD) generated by the lighting system 100 of FIG. 4 when connected to the AC power 120 is low. In fact, in some tests, the THD generated by the lighting system 100 of the present invention was in the range of less than ten percent.

Figure 10:
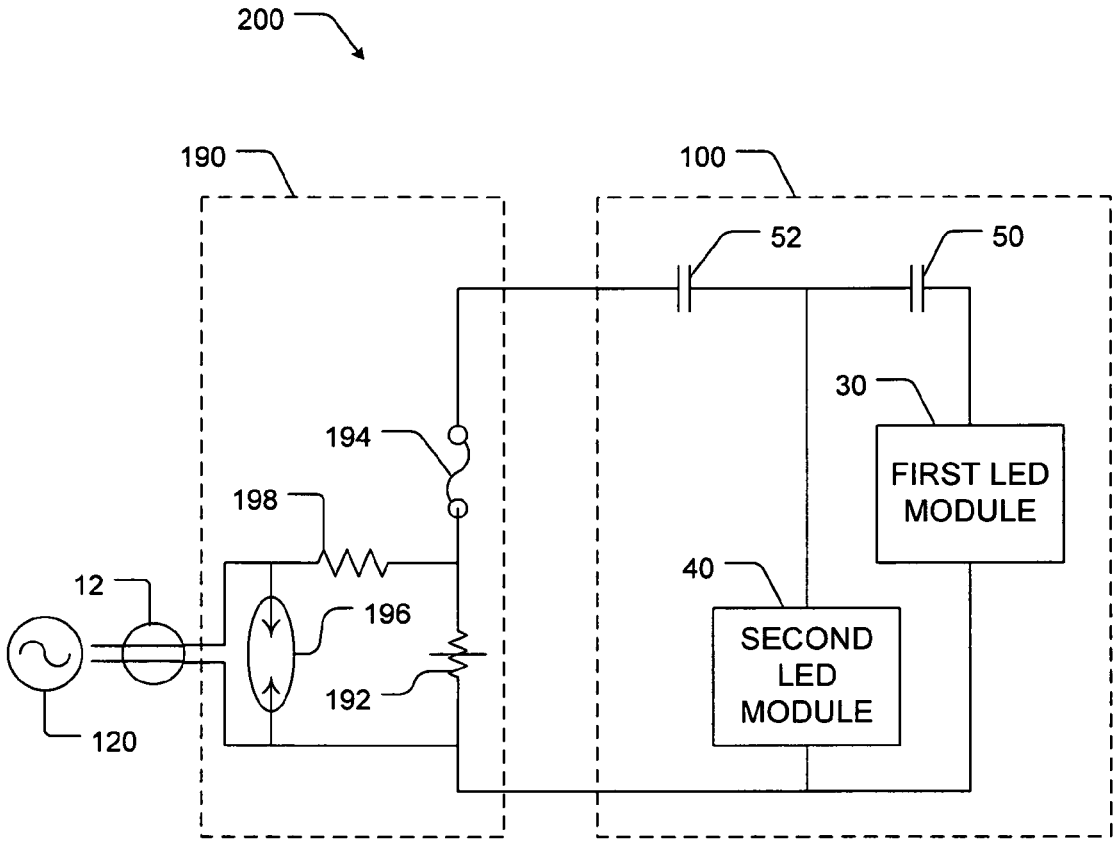
FIG. 10 is a schematic diagram of a lighting system in accordance with another embodiment of the present invention.

FIG. 10 illustrates another embodiment of the present invention. Referring to FIGS. 4 and 10, a lighting system 200 includes the lighting system 100 of FIG. 4 and supporting circuit 190. The supporting circuit 190 includes one or more components to protect the lighting system 100, to support the operations of the lighting system 100, or both. For example, the supporting circuit 190 is used to limit in-rush current at turn-on. If the in-rush current is not limited, the in-rush current may charge the capacitors 50 and 52 too rapidly, potentially damaging power switches used to activate the lighting system.

In the illustrated embodiment, thermistor 198 specifically provides in-rush current limiting when first powering the circuit. In case the mains voltage is at the peak of its waveform when first applied to the circuit, there would be a relatively fast voltage surge across capacitive elements, leading to a large in-rush or surge current that could harm the LEDs or other components. When cold, the thermistor 198 acts as a resistor to minimize surge current. When heated (due to the operation of the system 200) the thermistor 198 offers decreased resistance so as minimize the resistive effects against the flow of current through the system 200. Additionally, a fuse 194 may briefly experience a large current that could cause it to fail open, were it not for the thermistor 198.

The supporting fuse 194 is connected in series with the lighting system 100. The fuse 194 protects the lighting system 100 by opening the circuit (thereby disconnecting the lighting system 100 from the power source 120) in case of excessive current flows. Rating of the fuse 194 varies depending on the implementation. In the illustrated embodiment, as an example only, the fuse 194 may have a rating in the order of one or two amperes.

Another protective device is a spark gap 196 that protects the lighting system 100 from excessive input voltage. When excessive voltage is applied to the lighting system 100, the current jumps the spark gap 196 rather than being directed to the lighting system 100 thereby protecting the lighting system 100 from the excessive voltage. Rating of the spark gap 196 varies depending on the implementation. In the illustrated embodiment, as an example only, the spark gap 196 may have a rating on the order of one kilo-volts.

In the illustrated embodiment, the supporting circuit 190 includes a transient voltage suppressor 192 such as, for example, a metal oxide variable (MOV) resistor 192 to prevent a voltage spike on lighting system 100 when transient voltage surges appear on the power source 120. The MOV resistor 192 can be, for example, MOV resistor known as part VE13M00151K in the marketplace. The MOV resistor 192 is connected in parallel with the lighting system 100, through the fuse 194.

The supporting circuit 190 need not include all the components illustrated in FIG. 10. For example, the supporting circuit 190 can be as simple as including only the MOV resistor 192 and still be within the scope of the present invention. The supporting circuit 190 may include any combination of the components illustrated. Furthermore, the supporting circuit 190 may include additional components not illustrated therein and still be within the scope of the present invention.

Figure 11:
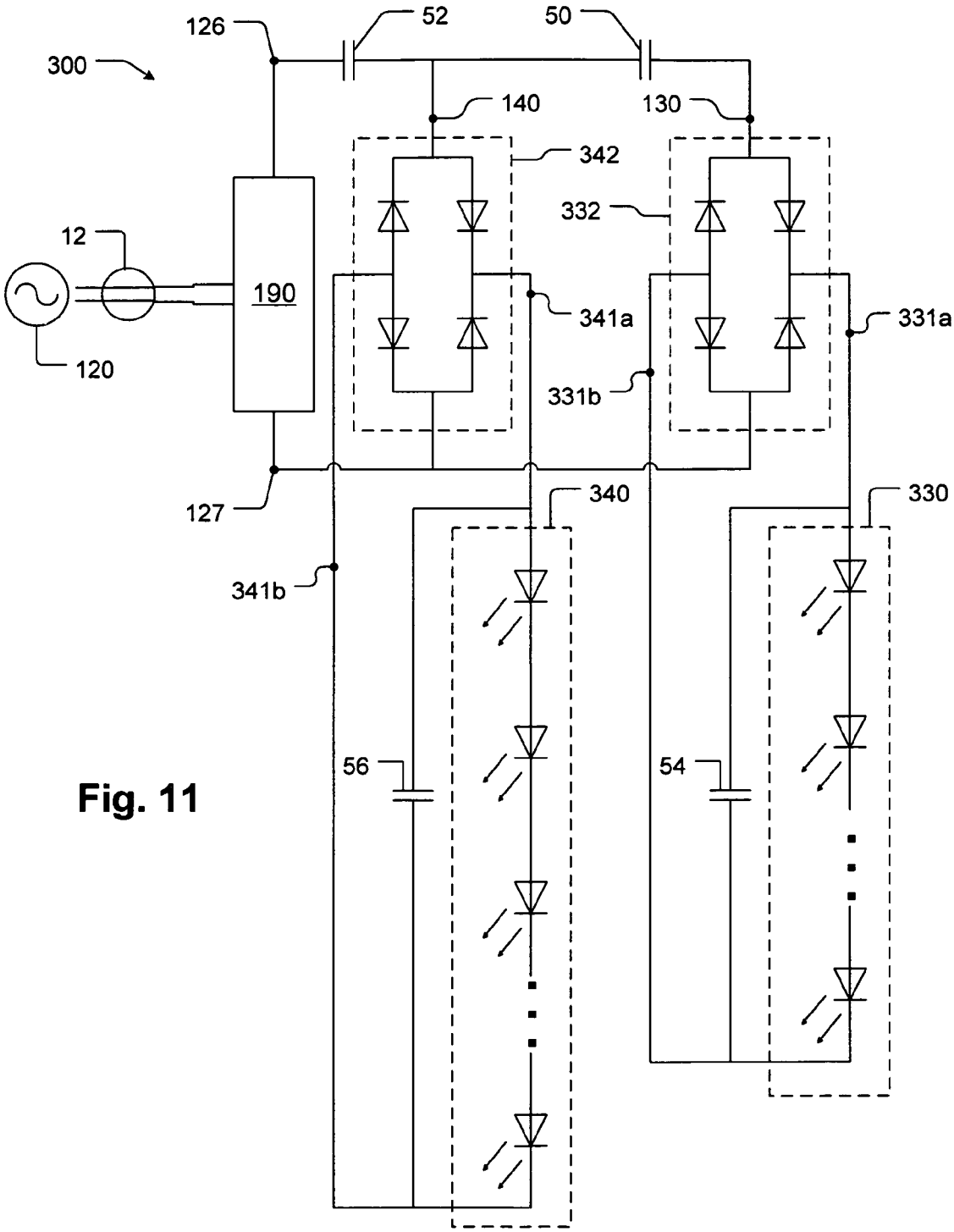
FIG. 11 is a schematic diagram of a lighting system in accordance with yet another embodiment of the present invention.

FIG. 11 illustrates yet another embodiment of the present invention. Referring to FIG. 11, a lighting system 300 includes a first lighting module 330 including at least one light emitting element. In the illustrated embodiment, the first lighting module 330 includes a plurality light emitting diodes of serially connected in a forward direction. Again, the designation of forward or reverse is arbitrary. A first rectifier 332 is connected to the first lighting module 330. A first capacitor 50 is connected to the first rectifier 332. For the first lighting module 330, each light emitting element can be a light emitting diode (LED) such as, for example LED model LW540A which operate generally between three to four forward volts. LW540A and similar LEDs are available in the marketplace. In the illustrated embodiment, the first lighting module 330 includes 12 serially connected LEDs. The first rectifier 332 can have any known rectifier configuration. In the illustrated embodiment, the first rectifier 332 is a diode-bridge type rectifier having the illustrated configuration, each diode being, for example, a 1N4004 rectifier diode available in the marketplace. The first capacitor 50 can be, for example, a 1.47 μF 100V Polyester type capacitor. The actual model, value, and type of these diode and capacitor components and the number of LEDs in the first lighting module 330 may vary depending on application.

In the illustrated embodiment, the second lighting module 340 includes a plurality of light emitting diodes of connected in a forward direction. Again, the designation of forward or reverse is arbitrary. A second rectifier 342 is connected to the second lighting module 340. For the second lighting module 340, each light emitting element can be a light emitting diode (LED) such as, for example type LW540A discussed above. In the illustrated embodiment, the second lighting module 340 includes 23 serially connected LEDs. The second rectifier 342 can have any known rectifier configuration. In the illustrated embodiment, the second rectifier 342 is a diode-bridge type rectifier having the same configuration and components as the first rectifier 332. The actual model, value, and type of these diode and capacitor components and the number of LEDs in the second lighting module 340 may vary depending on application. The second lighting module 340 and the second rectifier 342 are connected to the first lighting module 330 and the first rectifier 332 in parallel. Continuing to refer to FIG. 11, a second capacitor 52 is connected in series with both the first rectifier 332 and the second rectifier 342. The second capacitor can be, for example, a 3.75 μF 250V Polyester type capacitor. The lighting system 300 may but not necessarily include the supporting circuit 190 illustrated in more detail in FIG. 10 and discussed above.

The operations of the lighting system 300 are mostly similar to the operations of the lighting system 100 of FIG. 4 and discussed above using FIGS. 4 through 9, inclusive, with minor differences. The AC power source 120 provides AC voltage 120*v* illustrated in FIGS. 5, 8, and 9 as it may appear at node 126. The AC voltage is operated by the second capacitor 52 as illustrated in FIG. 6 and discussed above such that voltage at node 140 appears as graph 140*v* illustrated in FIGS. 5 and 7 and discussed above. The voltage 140*v* at node 140 is operated on by the first capacitor 50, resulting as the voltage 130*v* at node 130 illustrated in FIGS. 5 and 6 and discussed above.

Figure 12A:
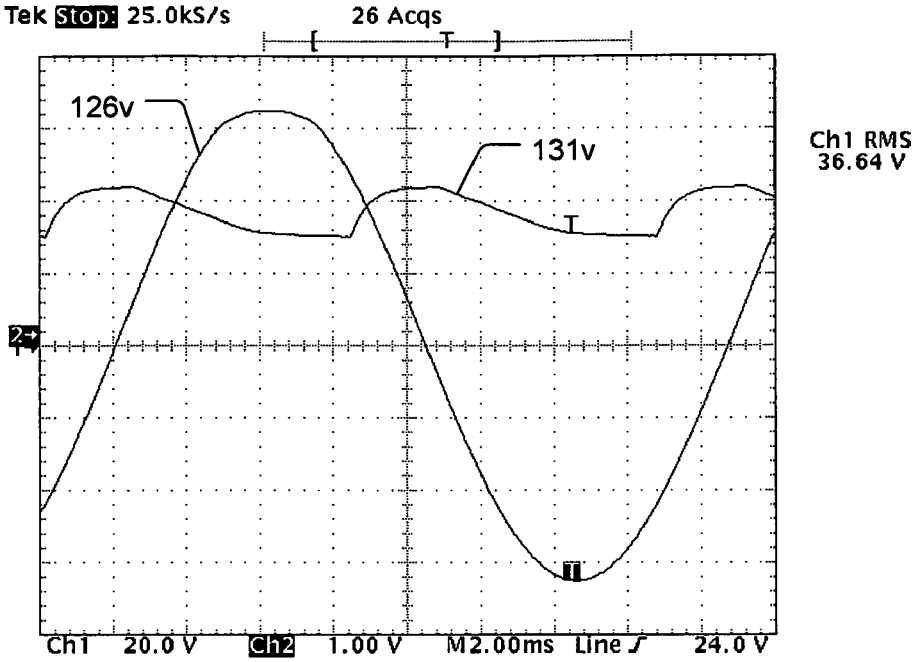
FIGS. 12*a* through 12*e*, inclusive, illustrate graphs representing various electrical characteristics of the lighting systems of FIG. 11.

Referring now to FIGS. 5 through 9 and 11, in the lighting system 300, the voltage 130*v* at node 130 is rectified by the first rectifier 332 such that, at node 331, a pulsed-DC (direct current) voltage is present. The pulsed-DC voltage at node 331 causes the current to flow through the LEDs of the first lighting module 330. The pulsed-DC voltage at node 331 is illustrated by graph 331*v* of FIG. 12*a*. Referring to Figures to FIGS. 5 through 9, 11, and 12*a*, the illustrated pulsed-DC voltage graph 331*v* is a measured waveform between nodes 331*a* and 331*b*. FIG. 12*a* also illustrates the approximate sine wave 126*v* as the voltage measured between nodes 126 and 127.

As the graph 331*v* indicates, the first rectifier 332 rectifies the input voltage into a pulsed-DC voltage waveform. The pulsed-DC voltage at 331*v* may be conditioned, or smoothed, by a third capacitor 54 placed in parallel to the first lighting module 330. The third capacitor 54, for example only, can be a 1.0 μF 200V electrolytic type capacitor. The third capacitor 54 reduces ripples of the pulsed-DC voltage at 331. Such ripple reduction may be useful for some types of light emitting elements.

Figure 12B:
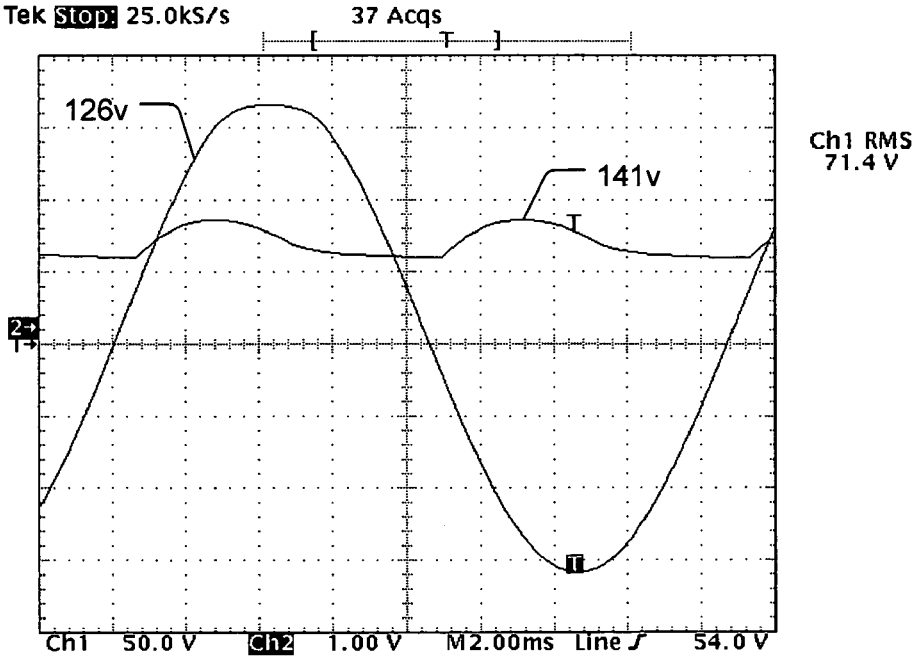

Continuing to refer to FIGS. 5 through 9, and 11, and also referring to FIG. 12*b*, in the lighting system 300, the voltage 140*v* at node 140 is rectified by the second rectifier 342 such that, at node 341, a pulsed-DC (direct current) voltage is present. The pulsed-DC voltage at node 341 causes the current to flow through the LEDs of the second lighting module 340. The pulsed-DC voltage at node 341 is illustrated by graph 341*v* of FIG. 12*b*. In FIG. 12*b*, the illustrated pulsed-DC voltage graph 341*v* is a measured waveform between nodes 341*a* and 341*b*. FIG. 12*a* also illustrates the approximate sine wave 126*v* as the voltage measured between nodes 126 and 127.

As the graph 341*v* indicates, the second rectifier 342 rectifies the input voltage into a pulsed-DC waveform. The pulsed-DC voltage at 341 may be conditioned, or smoothed, by a fourth capacitor 56 placed in parallel to the second lighting module 340. The fourth capacitor 56, for example only, can be a 1.0 μF 200V electrolytic type capacitor. The fourth capacitor 56 reduces ripples of the pulsed-DC voltage at 341. Such ripple reduction may be useful for some types of light emitting elements.

The lighting system 300 of FIG. 11 is different from the lighting system 100 of FIG. 4 in that the internal AC voltages at nodes 130 and 140 are rectified before being applied to lighting modules to generate light. However, the current flow characteristics of the lighting system 300 of FIG. 11 are substantially similar to that of the lighting system 100 of FIG. 4.

Figure 12C:
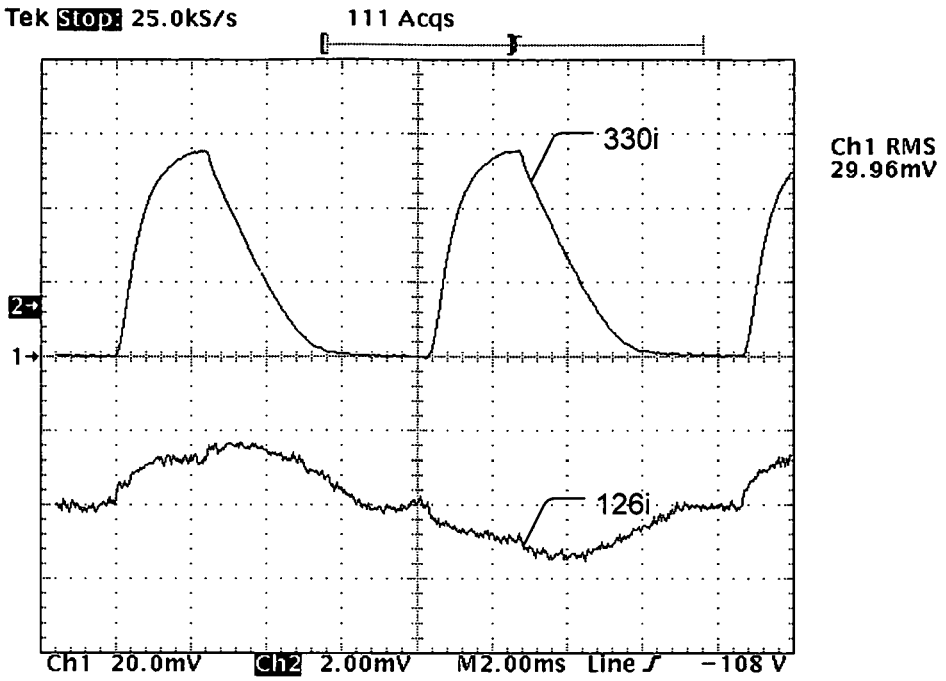
Figure 12D:
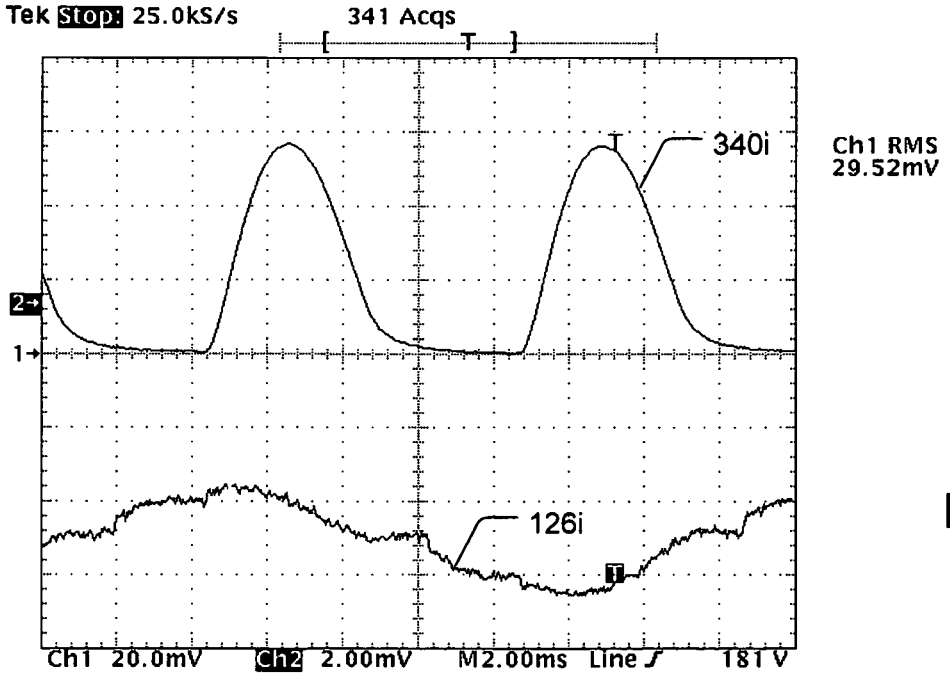

The current drawn by the first lighting module 330 is illustrated in FIG. 12*c* as graph 330*i*. The current graph 330*i* was measured by placing the oscilloscope probes across a ten-ohm resistor in series at node 331*a*. FIG. 12*c* also illustrates the measured input current at node 126 as current graph 126*i*. The current graph 126*i* was measured with a floating probe across a ten-ohm resistor. Note that the use of the floating probe introduced noise on that signal trace such that the measured current graph 126*i* is not smooth but appears serrated. The current drawn by the second lighting module 340 is illustrated in FIG. 12*d* as graph 340*i*. The current graph 340*i* was measured by placing the oscilloscope probes across a ten-ohm resistor in series at node 341*a*. FIG. 12*d* also illustrates the measured input current at node 126 as current graph 126*i*.

Figure 12E:
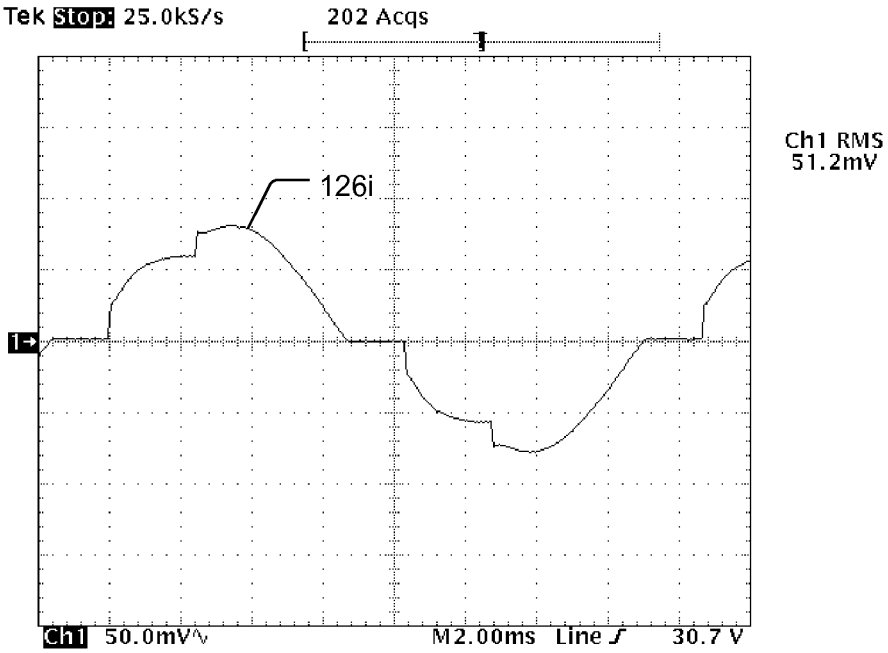

When the currents at nodes 331*a* and 341*a* combine, they sum to the current graph 126*i*. The current graph 126*i* measured between nodes 126 and 127 is illustrated in FIG. 12*e* as current graph 126*i*. The current graph 126*i* of FIGS. 12*c* and 12*d*; however, the probe used is not floating and no noise is introduced to the measurement.

Note that the overall system current as represented by the current graph 126*i* of FIG. 12*e* is similar to the 126*i* of FIG. 9. Comparing FIG. 9, with respect to the system 100 of FIG. 4, it is apparent that the shape of the light system current 126*i* (of FIG. 9) is similar to the shape of the power supply voltage 120*v*. That is, the shape of the light system current 126*i* (of FIG. 9) is only slightly distorted compared to the shape of the power supply voltage 120*v*. Accordingly, the total harmonic distortion (THD) generated by the lighting system 100 of FIG. 4 when connected to the AC power 120 is low. Likewise, comparing FIG. 9 with respect to the system 300 of FIG. 11, it is apparent that the shape of the light system current 126*i* (of FIG. 12*e*) is similar to the shape of the power supply voltage 126*v* (of FIGS. 12*a* and 12*b*). That is, the shape of the light system current 126*i* (of FIG. 12*e*) is only slightly distorted compared to the shape of the power supply voltage 126*v* (of FIGS. 12*a* and 12*b*). Accordingly, the total harmonic distortion (THD) generated by the lighting system 300 of FIG. 11 when connected to the AC power 120 is low.

Figure 13:
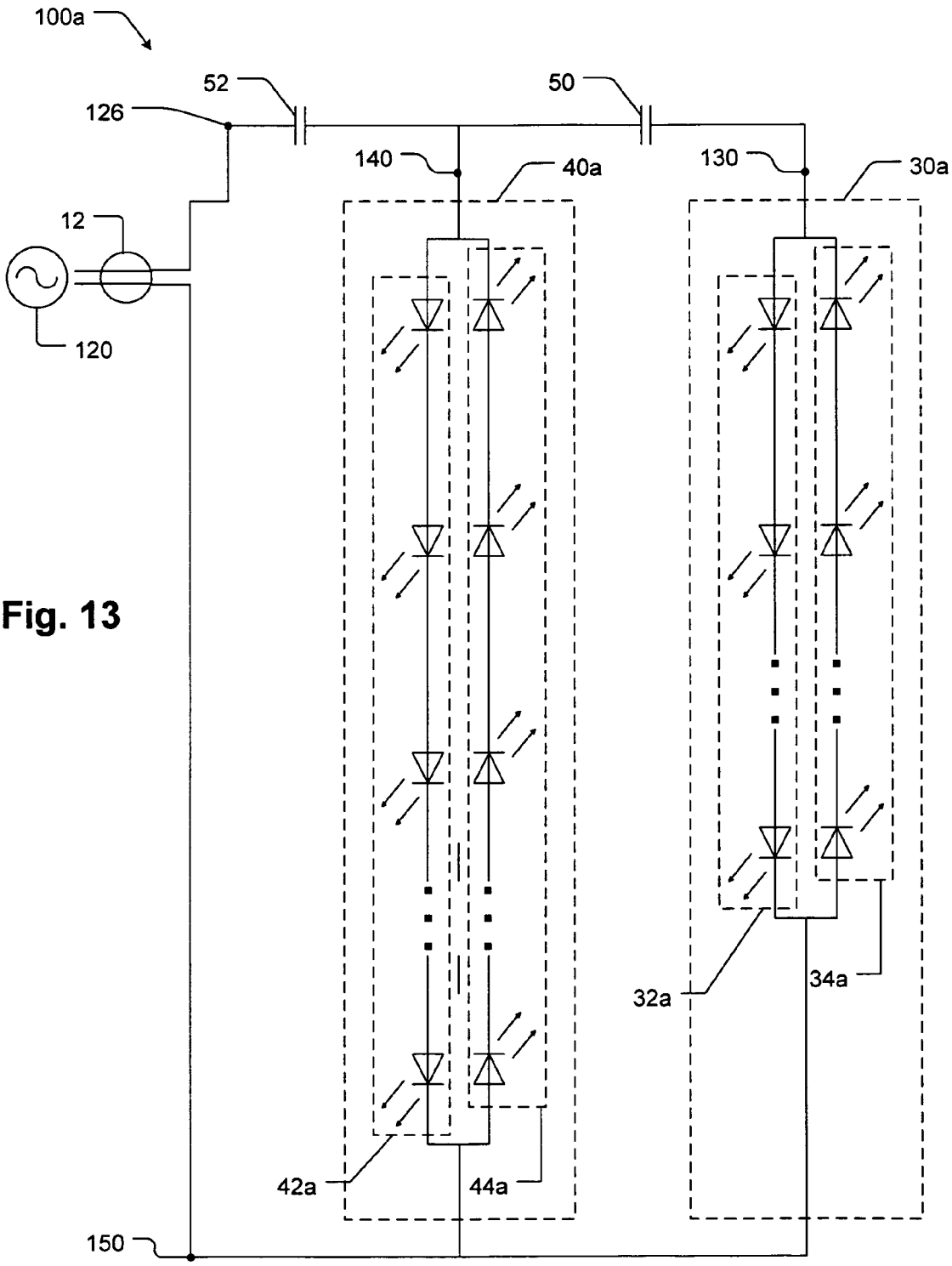
FIG. 13 is a schematic diagram of a lighting system in accordance with yet another embodiment of the present invention.

FIG. 13 illustrates an alternative embodiment of the lighting system 100*a* of the present invention. The lighting system 100*a* of FIG. 13 is substantially similar to the lighting system 100 of FIG. 4. However, in the lighting system 100*a* of FIG. 13, the first lighting module includes two sets of LEDs 32*a* and 34*a*. The first set of LEDs 32*a* includes a plurality of LEDs serially connected in forward direction and a second set of LEDs 34*a* includes a plurality of LEDs serially connected in reverse direction. Likewise, the second lighting module includes two sets of LEDs 42*a* and 44*a*. The first set of LEDs 42*a* includes a plurality of LEDs serially connected in forward direction and a second set of LEDs 44*a* includes a plurality of LEDs serially connected in reverse direction.

Note that although the invention has been described in terms of LEDs, the invention and embodiments described herein are not limited to LEDs but may be used with other light emitting devices such as, for example only, Organic Light Emitting Diode (OLED), Light Emitting Polymer (LEP), and Organic Electro Luminescence (OEL), or any other lighting element that generates or causes total harmonic distortion at a level that is higher than desired. The present invention is applicable to and includes regions where the supplied AC power is at 240 volts such as in Europe or other parts of the world. The present invention is applicable to and includes regions where the supplied AC power is at 50 Hz such as in Europe or 400 Hz such as on board an aircraft. The present invention is applicable to and includes use of rectifiers other than the illustrated example rectifiers which are used only for the purposes of disclosing the invention. The lighting system of the present invention can be, for example, a light bulb, a lighting surface, a light wall, a projection system, and the like that includes a plurality of light emitting elements such as LEDs.

What is claimed is:

1. A lighting system adapted to connect to an electrical power source providing alternating current (AC) electrical power, the electrical power having power cycles, the lighting system comprising:

a first lighting module including at least one light emitting element;

a second lighting module including at least one light emitting element, said second lighting module connected in parallel to said first lighting module;

a first capacitor connected in series with said first lighting module, said first capacitor connected in parallel to said second lighting module;

a second capacitor connected in series with both said first lighting module and said second lighting module; and wherein, when electrical power is applied to the lighting system, said first lighting module conducts electrical current during a first conduction period within each power cycle and said second lighting module conducts electrical current during a second conduction period within each power cycle.

2. The lighting system recited in claim 1 wherein a portion of the first conduction period overlaps a portion of the second conduction period.

3. The lighting system recited in claim 1 wherein said first lighting module, when connected to the electrical power source, conducts during a third conduction period within each power cycle; and wherein said second lighting module, when connected to the electrical power source, conducts during a fourth conduction period within each power cycle.

4. The lighting system recited in claim 3 wherein a portion of the third conduction period overlaps a portion of the fourth conduction period.

5. The lighting system recited in claim 1 wherein said first lighting module includes a plurality of LED pairs wherein each LED pair includes a first LED connected in forward direction and a second LED connected in reverse direction.

6. The lighting system recited in claim 1 wherein said first lighting module includes two sets of LEDs wherein a first set of LEDs including a plurality of LEDs serially connected in forward direction and a second set of LEDs including a plurality of LEDs serially connected in reverse direction.

7. The lighting system recited in claim 1 wherein said first lighting module includes a first predetermined number of LEDs and said second lighting module includes a second predetermined number of LEDs wherein the first predetermined number is less than the second predetermined number.

8. The lighting system recited in claim 1 wherein said first lighting module includes a first predetermined number of LEDs and said second lighting module includes a second predetermined number of LEDs wherein the first predetermined number is less than the second predetermined number, achieving substantially sinusoidal current draw from the AC power source when the AC power source provides substantially sinusoidal voltage.

9. A lighting system adapted to connect to an electrical power source providing alternating current (AC) electrical power, the electrical power having power cycles, the lighting system comprising:

a first lighting module including at least one light emitting element;

a first rectifier connected to said first lighting module, said first rectifier connected to provide a first rectified signal to said first lighting module;

a second lighting module including at least one light emitting element;

a second rectifier connected to said second lighting module, said second rectifier connected to provide a second rectified signal to said second lighting module;

wherein said first rectifier and said first lighting module are connected in parallel to second rectifier and said second lighting module;

wherein, when electrical power is applied to the lighting system, said first lighting module conducts electrical current during a first conduction period within each power cycle and said second lighting module conducts electrical current during a second conduction period within each power cycle.

10. The lighting system recited in claim 9 wherein a first capacitor is connected in series with said first lighting module.

11. The lighting system recited in claim 10 wherein a fourth capacitor is connected parallel to said second lighting module.

12. The lighting system recited in claim 9 wherein a second capacitor is connected in series with said first lighting module and also with said second lighting module.

13. The lighting system recited in claim 9 wherein a third capacitor is connected parallel to said first lighting module.

14. The lighting system recited in claim 9 wherein a portion of the first conduction period overlaps a portion of the second conduction period.

15. The lighting system recited in claim 14 wherein said first lighting module, when connected to the electrical power source, conducts during a third conduction period within each power cycle; and wherein said second lighting module, when connected to the electrical power source, conducts during a fourth conduction period within each power cycle.

16. The lighting system recited in claim 15 wherein a portion of the third conduction period overlaps a portion of the fourth conduction period.

17. The lighting system recited in claim 9 wherein said first lighting module includes a first predetermined number of LEDs and said second lighting module includes a second predetermined number of LEDs wherein the first predetermined number is less than the second predetermined number.

18. A lighting system adapted to connect to an electrical power source providing alternating current (AC) electrical power, the electrical power having power cycles and first and second terminals, the lighting system comprising:

a first lighting module including at least one light emitting element, the first module having first and second terminals;

a second lighting module including at least one light emitting element, the second module having first and second terminals;

a first capacitor connected between said first terminal of first lighting module and said first terminal of said power supply;

a second capacitor connected between both said first terminal of said first lighting module and said first terminal of said second lighting module;

wherein the second terminals of said power supply, first lighting module, and second lighting module are all connected together; and wherein, when electrical power is applied to the lighting system, said first lighting module conducts electrical current during a first conduction period within each power cycle and said second lighting module conducts electrical current during a second conduction period within each power cycle.

19. The lighting system recited in claim 18 wherein a portion of the first conduction period overlaps a portion of the second conduction period.

20. The lighting system recited in claim 18 wherein said first lighting module, when connected to the electrical power source, conducts during a third conduction period within each power cycle; and wherein said second lighting module, when connected to the electrical power source, conducts during a fourth conduction period within each power cycle.

21. The lighting system recited in claim 18 wherein a portion of the third conduction period overlaps a portion of the fourth conduction period.

22. The lighting system recited in claim 18 wherein said first lighting module includes a plurality of LED pairs wherein each LED pair includes a first LED connected in forward direction and a second LED connected in reverse direction.

23. The lighting system recited in claim 18 wherein said first lighting module includes two sets of LEDs wherein a first set of LEDs including a plurality of LEDs serially connected in forward direction and a second set of LEDs including a plurality of LEDs serially connected in reverse direction.

24. A lighting system adapted to connect to an electrical power source providing alternating current (AC) electrical power, the electrical power source having power cycles and first and second terminals, the lighting system comprising:

a first lighting module including at least one light emitting element, the module having first and second terminals;

a first bridge rectifier connected to said first lighting module, said first bridge rectifier having first and second AC input terminals, connected to provide a first rectified signal to said first lighting module;

a second lighting module including at least one light emitting element, the module having first and second terminals;

a second bridge rectifier connected to said second lighting module, said second bridge rectifier having first and second AC input terminals, said second rectifier connected to provide a second rectified signal to said second lighting module;

wherein said first bridge rectifier and said first lighting module are connected in parallel to second bridge rectifier and said second lighting module;

wherein, when electrical power is applied to the lighting system, said first lighting module conducts electrical current during a first conduction period within each power cycle and said second lighting module conducts electrical current during a second conduction period within each power cycle.

25. The lighting system recited in claim 24 wherein a first capacitor is connected in series with said first lighting module.

26. The lighting system recited in claim 24, with a first capacitor is connected between said first terminal of first bridge rectifier and said first terminal of said power supply; and a second capacitor is connected between said first terminal of first lighting module and said first terminal of said second bridge rectifier with the second terminals of said power supply, first bridge rectifier, and second bridge rectifier are all wired together.

27. The lighting system recited in claim 24 wherein a third capacitor is connected parallel to said first lighting module.

28. The lighting system recited in claim 27 wherein a fourth capacitor is connected parallel to said second lighting module.

29. The lighting system recited in claim 24 wherein a portion of the first conduction period overlaps a portion of the second conduction period.

30. The lighting system recited in claim 29 wherein said first lighting module, when connected to the electrical power source, conducts during a third conduction period within each power cycle; and wherein said second lighting module, when connected to the electrical power source, conducts during a fourth conduction period within each power cycle.

31. The lighting system recited in claim 30 wherein a portion of the third conduction period overlaps a portion of the fourth conduction period.

32. The lighting system recited in claim 24 wherein said first lighting module includes a first predetermined number of LEDs and said second lighting module includes a second predetermined number of LEDs wherein the first predetermined number is less than the second predetermined number, achieving substantially sinusoidal current draw from the AC power source when the AC power source provides substantially sinusoidal voltage.

* * * * *